US010806555B2

(12) United States Patent
Schmitt et al.

(10) Patent No.: US 10,806,555 B2
(45) Date of Patent: Oct. 20, 2020

(54) STORAGE RECEPTACLE FOR STRAWS FOR PACKAGING ANIMAL SEMEN AND PROCESSING INSTALLATION COMPRISING SUCH A RECEPTACLE

(71) Applicant: IMV TECHNOLOGIES, Saint Ouen sur Iton (FR)

(72) Inventors: Eric Schmitt, Villaines-la-Juhel (FR); Jean-Charles Gorges, Chenay (FR); Christian Beau, Toussus-le-Noble (FR); Ludovic Lefranc, Les Aspres (FR)

(73) Assignee: IMV TECHNOLOGIES, Saint Ouen sur Iton (FR)

( * ) Notice: Subject to any disclaimer, the term of this patent is extended or adjusted under 35 U.S.C. 154(b) by 154 days.

(21) Appl. No.: 15/776,482

(22) PCT Filed: Sep. 16, 2016

(86) PCT No.: PCT/FR2016/052356
§ 371 (c)(1),
(2) Date: May 16, 2018

(87) PCT Pub. No.: WO2017/085365
PCT Pub. Date: May 26, 2017

(65) Prior Publication Data

US 2018/0325642 A1 Nov. 15, 2018

(30) Foreign Application Priority Data

Nov. 19, 2015 (FR) ..... 15 61120

(51) Int. Cl.
*B01L 3/00* (2006.01)
*B65B 19/34* (2006.01)
(Continued)

(52) U.S. Cl.
CPC ..... *A61D 19/024* (2013.01); *B65B 19/34* (2013.01)

(58) Field of Classification Search
None
See application file for complete search history.

(56) References Cited

U.S. PATENT DOCUMENTS 3,931,661 A 1/1976 Horsting et al.
4,094,123 A 6/1978 Carlson
(Continued)

FOREIGN PATENT DOCUMENTS

EP 1876100 A1 1/2008
FR 2835508 A1 8/2003
(Continued)

OTHER PUBLICATIONS

"SpermNotes—The International AI Newsletter from MinitUb No. Oct. 2005", Jan. 1, 2005 XP055202494, <http://www.minitube.de/DE eng/content/download/2470/97350/version/4/file/SpermNotes Bovine2005.pdf>.

*Primary Examiner* — Nathan A Bowers
(74) *Attorney, Agent, or Firm* — Browdy and Neimark, P.L.L.C.

(57) ABSTRACT

The invention relates to a storage receptacle (1) with a longitudinal opening (5) through which straws (2) for packing liquid-based substance are passed in a predetermined orientation of the straws, a housing (3) provided for the straws and configured to be inserted slidably in a cover (4) of the receptacle, the latter having an open configuration, in which the housing is partially inserted in the cover and the opening is free for the passage of the straws, and a closure configuration, in which the housing is inserted in the cover and the opening is closed by the cover in order to prohibit the passage of the straws. The housing has a parallelepipedal shape, a first front wall in which the opening is formed, a
(Continued)

first bottom wall, two first longitudinal wails extending parallel to the opening, and two first side walls which each have two diagonals of a length less than or equal to the length of the straws.

19 Claims, 15 Drawing Sheets

(51) Int. Cl.
*A61D 19/00* (2006.01)
*A61D 19/02* (2006.01)

(56) References Cited

U.S. PATENT DOCUMENTS 4,262,494 A * 4/1981 Karow, Jr. ..... A01N 1/02 62/384
4,497,432 A 2/1985 Milia
4,767,022 A * 8/1988 Oldorf ..... G07F 11/18 221/191
5,447,253 A * 9/1995 Williams ..... A61F 6/005 220/526
5,597,114 A * 1/1997 Kramedjian ..... B65D 5/4275 229/122.1
8,925,289 B2 1/2015 Lecointe
2007/0278115 A1* 12/2007 Ghini ..... B65D 5/38 206/248
2008/0092581 A1* 4/2008 Schumann ..... A01N 1/02 62/378
2014/0374287 A1* 12/2014 Holford ..... B65D 85/1045 206/248
2015/0011000 A1* 1/2015 Stojanov ..... A01N 1/0257 435/374
2017/0000109 A1* 1/2017 Xing ..... A01N 1/0284

FOREIGN PATENT DOCUMENTS

FR 2905592 A1 3/2008
GB 2498733 A 7/2013
WO 2006013825 A1 2/2006

* cited by examiner

STORAGE RECEPTACLE FOR STRAWS FOR PACKAGING ANIMAL SEMEN AND PROCESSING INSTALLATION COMPRISING SUCH A RECEPTACLE

FIELD OF THE INVENTION

The invention generally relates to the preservation of a liquid-based substance containing biological material, in particular animal semen, in packaging straws filled with a predetermined dose of such a substance.

More particularly, the invention concerns a receptacle for at least temporary storage of such straws, between at least two steps of processing those straws.

These may for example be steps of printing straws, filling straws and/or of welding straws.

The invention also relates to a processing installation comprising one or more machines for processing straws as well as such a storage receptacle.

These may for example be machines for printing straws, filling straws and/or of welding straws.

TECHNOLOGICAL BACKGROUND

Straws for packaging animal semen are conventionally formed by a thin tube of plastic material and by a stopper engaged in the thin tube. This stopper is formed by two plugs of fibrous substance which enclose a powder which transforms on contact with a liquid, into an impermeable gel or paste adhering to an inside wall of the tube, in order for the stopper to be fluid-tight.

Installations are known for processing and in particular for printing straws which comprise a printing machine and a storage device disposed at an exit of the machine and which is configured to receive the straws after printing.

Such a printing machine is generally provided with a hopper for supplying straws at an entry to the machine, with a printing unit, with a device for conveying the straws from the hopper towards the printing unit, and also from the printing unit to the exit from the machine where the straws are ejected and fall into the storage device.

In these printing installations, the storage device is formed by a receptacle, in the form of a box open on the top, in which the straws fall in disorder.

The straws are retaken manually by an operator from the receptacle to be transferred and introduced in a more or less ordered manner into packaging for temporary storage, for the purpose of a later step of processing those straws, for example a step of filling and welding of those straws.

Treatment installations and in particular those for filling and welding straws are also known, which comprise a filling and welding machine configured to fill and weld straws, a movable support configured to receive the straws and convey them to the filling and welding machine, and a device for supplying and positioning the straws on the movable support.

Such an installation is for example described in European patent application EP 1 125 870.

The filling and welding machine conventionally comprises a vacuum pump and filling needles mounted on a carriage, which are configured to cooperate with the straws and to enable their filling.

The filling and welding machine further comprises a welding station configured to weld the ends of the straws after filling.

The movable support is generally formed by conveyor belts each having a plurality of grooves forming accommodations configured to receive the straws in a predetermined orientation.

The movable support is configured to convey the straws so accommodated thereon, from the supply and positioning device to the filling needles of the filling and welding machine for the filling of the straws, then from the filling needles to the welding station for the welding of the straws.

The supply and positioning device comprises a fixed supply hopper mounted on a frame of the installation and configured to receive a plurality of straws.

The supply hopper is provided with an inclined ramp and with a vertical channel, and the supply and positioning device further comprises a roller for separating the straws and a palette allowing the passage of the straws from the inclined ramp to the vertical channel; for the loading of these straws, three by three, into the grooves of the conveyor belts which provide the conveying of the straws towards the filling and welding machine.

The straws are extracted manually by an operator from the temporary storage packaging to be transferred and introduced into the supply hopper.

SUBJECT OF THE INVENTION

The invention is directed to providing a storage receptacle for straws that is configured to equip an installation for processing such straws, which is more convenient and provides better performance.

To that end, according to a first aspect, the invention provides a receptacle configured to store at least temporarily a plurality of straws, each of predetermined length and provided for the packaging of a predetermined dose of liquid-based substance, in particular animal semen, said receptacle being configured to equip an installation for processing said straws provided with one or more machines for processing said straws, characterized in that it comprises:

- a passage opening for said straws, extending at least in a longitudinal direction corresponding to a predetermined orientation of said straws for their passage;
- a first accommodation-forming part for accommodation of said straws and a cover-forming second part, said first part being configured to be slidingly inserted into said second part such that said receptacle has an opening configuration in which said first part is partially inserted into said second part and said opening is free for the passage of said straws through that opening in said predetermined orientation, and an obturating configuration in which said first part is inserted into said second part and said opening is obturated by said second part to prohibit the passage of said straws through said opening;

said first part having a parallelepiped shape and having a first front wall in which is at least partially provided said passage opening, a first back wall opposite said first front wall, two first longitudinal walls opposite each other, each meeting said first front wall and said first back wall and extending parallel to said passage opening, and two first lateral walls opposite each other and each meeting said first front wall, said first back wall and said two first longitudinal walls;

each first lateral wall having two diagonals each having a length less than or equal to said predetermined length of said straws.

The receptacle according to the invention, in its opening configuration, enables the filling with straws of the accommodation-forming first part and also enables the emptying of this first part forming accommodation.

It will be noted that the filling of the first part forming accommodation may be carried out for example at an exit of a printing machine for straws; while the emptying of this first part forming accommodation can be carried out for example at an entry of a machine for filling and/or welding straws.

The receptacle is thus configured to be used just as well in a processing installation for straws comprising a printing machine for straws, in a processing installation for straws comprising a machine for filling and/or welding straws, and in a processing installation for straws comprising these two machines.

Therefore, the receptacle is as such sufficient to pass the straws from one processing installation to the other and/or from one processing machine to the other.

In other words, there is no need for additional packaging for transporting the straws from one processing installation to the other and/or from one processing machine to the other. This implies that there is no need either, for an operator to manually grasp the straws to dispose them in such additional packaging.

The receptacle according to the invention, in its obturating configuration, enables the storage of the straws without risk of loss, inadvertent emptying and thus inability to retrieve the straws.

What is more, the structure of the receptacle and in particular its longitudinal passage opening enables the reception of the straws in the first part forming accommodation in their predetermined orientation; while the fact that the diagonals of each of its first lateral walls have a length less than or equal to the predetermined length of the straws, prevents these latter from turning round or, in other words, enables the straws to be kept in their predetermined orientation.

It will be noted that the receptacle is thus particularly convenient especially when the processing machines are at a distance and this requires the transport of the straws.

The holding of the straws in their predetermined orientation during possible transport also means that there is no longer a need for an operator to manually grasp the straws to put them back in their predetermined orientation before a processing step.

According to preferred, simple and convenient features of the receptacle according to the invention:

said first part comprises an internal space as well as a guide ramp formed by a first portion of said first front wall, which extends from the junction of the latter with one of the two said first longitudinal walls, and by a second inclined portion extending said first portion forming said guide ramp and extending in said internal space of said first part;

said first portion and said second inclined portion forming said guide ramp meet at a junction defining a first longitudinal inside edge of said first front wall and which partially delimits said passage opening;

said second inclined portion forming said guide ramp has an angle of inclination less than or equal to approximately 20° relative to said first longitudinal wall from which extends said first portion forming said guide ramp;

said second inclined portion forming said guide ramp extends until it meets said first longitudinal wall from which extends said first portion forming said guide ramp;

said first part has a longitudinal recess-forming strip, which is provided in said first front wall and delimited at least by a first longitudinal inside edge of said first front wall and by two lateral edges on said first part and opposite each other, said longitudinal recess-forming strip at least partially defining said passage opening;

said two lateral edges are formed on the two said first lateral walls such that said longitudinal strip extends from one to the other of these latter;

said first part has a cut-out provided in said first front wall and which is open to said recess-forming longitudinal strip, on the opposite side to said first longitudinal inside edge;

said cover-forming second part is of parallelepiped shape and has a second front wall, a second back wall opposite said second front wall, a second longitudinal wall meeting said second front wall and said second back wall, two second lateral walls opposite each other and each meeting said second front wall, said second back wall and said second longitudinal wall, and an opening for insertion of said first part into an internal space of said second part;

said internal space of said second part is delimited by said second front wall, said second back wall, said second longitudinal wall and said two second lateral walls; while said insertion opening is delimited by a front free edge of said second front wall, a back free edge of said second back wall, and two lateral free edges of said two second lateral walls;

said second part has at least one first cut-out provided both in said second longitudinal wall and in one of said second lateral walls, second front wall and second back wall;

said at least one first cut-out has a portion provided in one of said second lateral walls, second front wall and second back wall, which is configured to be at least partially opposite said first part, both in said obturating configuration and in said opening configuration in which said first part is partially inserted into said second part;

said second part has a second cut-out entirely formed in said second longitudinal wall;

said passage opening is entirely formed in said first part, or said opening is delimited by a longitudinal edge of said first part and by a longitudinal edge of said second part, situated opposite said longitudinal edge of said first part;

said receptacle comprises a device for locking in position said first part relative to said second part, configured to prevent said receptacle from freely passing from one to the other of its opening and obturating configurations;

said locking device comprises, on said first part, one of at least one projecting fin and at least one notch, and on said second part, the other of said at least one projecting fin and of said at least one notch, said at least one projecting fin being configured to be inserted into said at least one notch in the obturating configuration of said receptacle or in the opening configuration of said receptacle in which said first part is partially inserted into said second part; and/or said at least one projecting fin is formed by a first incision made in one of said first front wall, first back wall and first lateral walls of said first part, said at least one notch is formed by a second incision made in one of said second front wall, second back wall and second lateral walls of said second part; with, in the obturating configuration of said receptacle, said at least one projecting fin being received in said at least one notch and, in the opening configuration in which said first part is partially inserted into said second part, a free edge of one of said second front wall, second back wall and second lateral walls of said second part which rests on said at least one projecting fin.

According to a second aspect, the invention is also directed to a processing installation for straws comprising at least one machine for processing straws, as well as a receptacle as defined above.

According to preferred simple and convenient features of the installation according to the invention:

said receptacle comprises an identification medium configured to encode information identifying said straws stored in said receptacle, and said at least one processing machine comprises a control-command unit configured to retrieve said encoded information from said identification medium and for controlling and commanding said at least one processing machine according to said retrieved information;

said at least one processing machine is a printing machine for straws configured to eject, at an exit from said machine, said straws in said predetermined orientation, and said receptacle is disposed at an exit from said machine to receive said straws through said passage opening; and/or said at least one processing machine is a machine for filling and/or welding straws, comprising a supply hopper configured to receive said receptacle for the emptying of the latter.

BRIEF DESCRIPTION OF THE DRAWINGS

The disclosure of the invention will now be continued with the detailed description of embodiments, given below by way of non-limiting illustration, with reference to the appended drawings. In these.

DETAILED DESCRIPTION OF EMBODIMENTS

Figure 1:
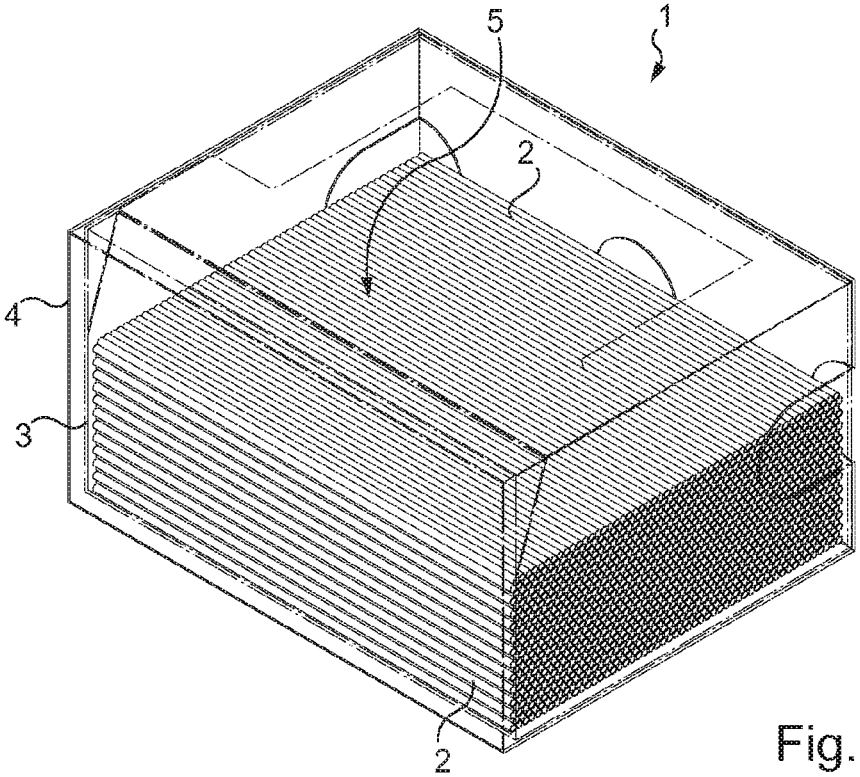
FIG. 1 is an illustration in perspective of a storage receptacle in accordance with the invention, in an obturating configuration, in horizontal position, and partially filled with straws, here in an ordered state and visible through transparency.

FIG. 1 illustrates a receptacle 1 for at least temporary storage of straws 2, here partly filled with such straws 2.

The receptacle 1 is mounted here in an obturating configuration in which the straws cannot escape therefrom, which enables them to be transported conveniently and in security.

The straws 2 each have a predetermined length and are each provided for the packaging of a predetermined dose of liquid-based substance, in particular animal semen.

The straws 2 for packaging animal semen are conventionally formed by a thin tube of plastic material and by a stopper (not shown) engaged in the thin tube. This stopper is formed by two plugs of fibrous substance which enclose a powder which transforms on contact with a liquid, into an impermeable gel or paste adhering to an inside wall of the tube, in order for the stopper to be fluid-tight.

For each straw 2, the stopper is engaged in the thin tube while being situated near one end of the straw 2. In practice, the straws 2 are disposed in the receptacle 1 with each having its end that is near the stopper oriented towards the same side of the receptacle 1.

The receptacle 1 is configured to equip a processing installation for the straws 2 which is provided with one or more processing machines for the straws 2.

The installation can be configured such that the receptacle 1 is disposed at an exit of a processing machine for receiving the straws 2 processed by that machine, or else such that the receptacle 1 is disposed at an entry of a processing machine for supplying the latter with straws to process.

Such processing installations are described later in the present description.

The receptacle 1 comprises a passage opening 5 (visible through transparency in FIG. 1) for the straws 2, extending at least in a longitudinal direction corresponding to a predetermined orientation of the straws 2 for their passage.

The receptacle 1 comprises a first part 3 forming accommodation for the straws 2 and a cover-forming second part 4, each of the first and second parts being made from plastic material, here recyclable, for example of polyethylene terephthalate (PET).

The first part 3 is configured to be slidingly inserted into the second part 4 such that the receptacle 1 has an opening configuration (shown in FIGS. 8, 9, 11 to 13 and 19) in which the first part 3 is partially inserted into the second part 4 and the opening 5 is free for the passage of the straws 2 through that opening 5 in the predetermined orientation, and an obturating configuration (shown in FIGS. 1, 7 and 18) in which the first part 3 is inserted into the second part 4 and the opening 5 is obturated by the second part 4 to prohibit the passage of the straws 2 through the opening 5.

The first part 3 will now be described in more detail with reference to FIGS. 2 and 3.

The first part 3 has a parallelepiped shape, here a rectangular parallelepiped shape, and has a first front wall 6 in which is at least partially provided the passage opening 5, a first back wall 7 opposite the first front wall 6, two first longitudinal walls 8 opposite each other, each meeting the first front wall 6 and the first back wall 7 and extending parallel to the passage opening 5, and two first lateral walls 9 opposite each other and each meeting the first front wall 6, the first back wall 7 and the two first longitudinal walls 8.

The first front wall 6, the first back wall 7, the two first longitudinal walls 8 and the two first lateral walls 9 define an internal space 24 of the first part 3.

Each first lateral wall 9 has two diagonals (represented in chain line in FIG. 2) each having a length less than or equal to the predetermined length of the straws 2.

More specifically, for each first lateral wall 9, each diagonal extends in the plane of that lateral wall 9 from the junction between the first front wall 6 and one of the two first longitudinal walls 8, to the junction between the first back wall 7 and the other of the two first longitudinal walls 8; such that the two diagonals cross.

The two diagonals have the same length since the first part 3 here is of rectangular parallelepiped shape.

This prevents the straws from turning round in the internal space 24 of the first part 3 and thus to be kept in their predetermined orientation.

The first front wall 6 has a U-shaped portion 11 and a portion in the form of a longitudinal strip 12 disposed either side of a longitudinal strip 10 forming a recess in that front wall 6.

The U-shaped portion 11 has two lateral bands 13 each extending partly along a respective first lateral wall 9 and a base strip 14 extending along one of the first longitudinal walls 8 and linking the lateral strips 13.

Each lateral strip 13 extends longitudinally from the first lateral wall 9 that it partly passes along, to a lateral inside edge 15 of the first front wall 6, at a distance from the respective first lateral wall 9.

Each of lateral strip 13 extends transversely from the base strip 14, to a second longitudinal inside edge 16 of the first front wall 6, at a distance from the base strip 14.

The base strip 14 extends longitudinally from one to the other of the first lateral walls 9 and extends transversely from the first longitudinal wall 8 that it passes along to a third longitudinal inside edge 17 of the first front wall 6, at a distance from the respective first longitudinal wall 8.

The first part 3 furthermore has a cut-out 21, of rectangular shape, provided in the first front wall 6 and laterally delimited by the lateral inside edges 15, longitudinally by the third longitudinal inside edge 17, as well as by the longitudinal recess-forming strip 10, to which the cut-out 21 is open, at the location of the longitudinal inside edge 16.

Figure 2:
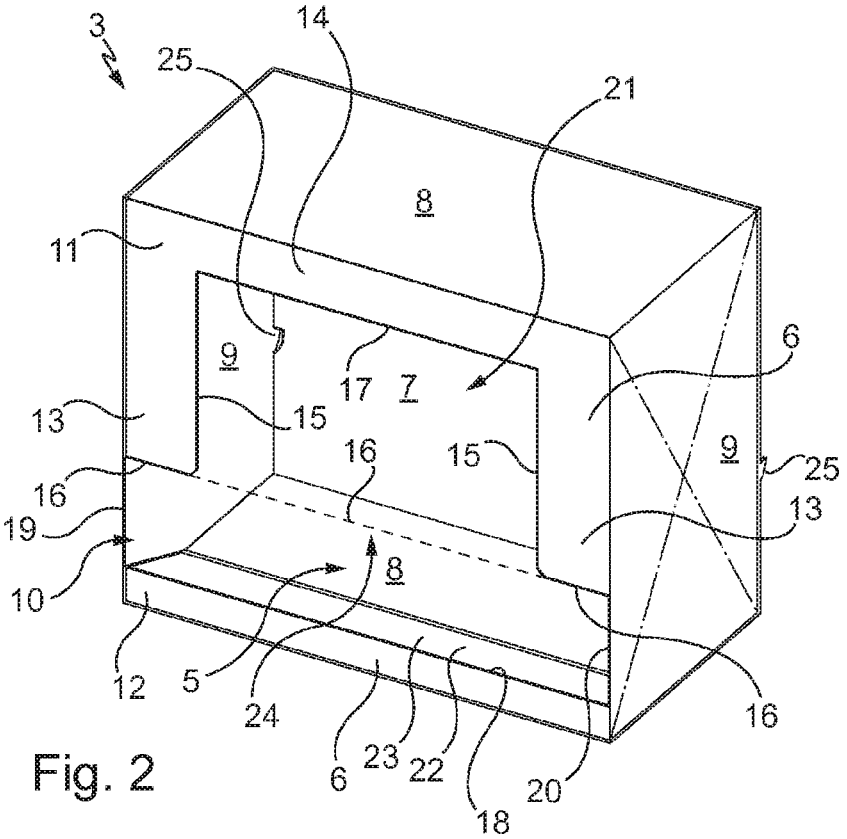
FIG. 2 illustrates, in perspective and in isolation, an accommodation-forming first part of the receptacle visible in FIG. 1.

It will be noted that the longitudinal inside edge 16 thus has an interruption between the two lateral strips 13 of the U-shaped portion 11, indicated diagrammatically by a dashed line in FIG. 2.

The portion of strip form 12 of the first front wall 6 extends longitudinally from one to the other of the first lateral walls 9, along the first longitudinal wall 8 which is opposite that which the base strip 14 of the U-shaped portion 11 passes along.

The portion of strip form 12 extends transversely from the first longitudinal wall 8 which it passes along, to a first longitudinal inside edge 18 of the first front wall 6.

The recess-forming longitudinal strip 10, which is provided in the first front wall 6, is delimited by the first and second longitudinal inside edges 16 and 18, which are opposite each other, and by two lateral edges 19 and 20, on the first part 3, which are opposite each other.

The two lateral edges 19 and 20 are each formed on one of the two respective first lateral walls 9 such that the longitudinal strip 10 extends from one to the other of these latter.

It will be noted that the cut-out 21 is open to the longitudinal strip 10 on the opposite side to the first longitudinal inside edge 18.

The first part 3 further comprises a guide ramp 22 formed by the portion of strip form 12 of the first front wall 6 and by an inclined portion 23 extending the portion of strip form 12 and that extends in the internal space 24 of the first part 3.

The portion of strip form 12 and the inclined portion 23 meet at the location of a junction defining the first longitudinal inside edge 18 of the first front wall 6 and which partially delimits the passage opening 5.

The inclined portion 23 here has an angle of inclination of approximately 20° relative to the first longitudinal wall 8 from which extends the portion of strip form 12.

More generally, this angle of inclination may be less than or equal to approximately 20°.

The inclined portion 23 extends to meet the first longitudinal wall 8 from which extends the portion of strip form 12.

In the obturating configuration of the receptacle 1, and on passage to its opening configuration, this guide ramp 22 makes it possible to keep the straws 2 at least temporarily in the internal space 24 of the first part 3.

This guide ramp 22 furthermore makes it possible, in the opening configuration of the receptacle 1, to facilitate the pouring of the straws 2 into a hopper of a processing machine for a later step of processing the straws 2, for example of filling and/or welding thereof (see below).

Figure 3:
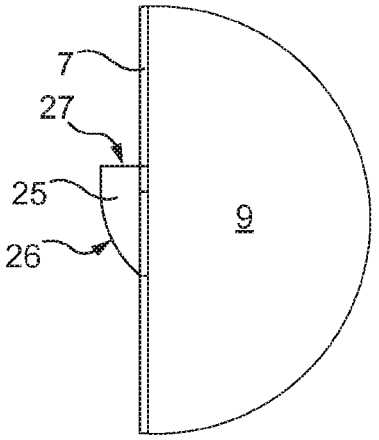
FIG. 3 is a plan view showing a detail of the accommodation-forming first part visible in FIG. 2.

The first part 3 is furthermore provided with two projecting fins 25, of which one is shown in detail in FIG. 3, forming part of a device for locking in position the first part 3 of the receptacle 1 relative to the second part 4 of the receptacle 1.

This locking device of the receptacle 1 is configured to prevent the receptacle 1 from passing freely from one to the other of its opening and obturating configurations.

Each projecting fin 25 is formed here by a first incision made in the first back wall 7 of the first part 3.

The projecting fins 25 are each situated at a same distance relative to one of the two first longitudinal walls 8 and are opposite each other, at the same level on the back wall 7.

Each projecting fin 25 projects from the junction between the first back wall 7 and one of the first lateral walls 9, extending in line with that lateral wall 9.

Each projecting fin 25 has a contour comprising a curved portion 26 oriented towards the first longitudinal wall 8 that is situated on the same side as is located the guide ramp 22 and/or the opening 5, and a straight portion 27, opposite the curved portion 26, and oriented towards the other longitudinal wall 8.

The curved portion 26 extends from the back wall 7 at a distance from the first respective lateral wall 9 to a free edge; while the straight portion 27 also extends from the back wall 7 at a distance from the respective first lateral wall 9 to meet the curved portion 26 at the location of the free edge.

It will be noted that the first incision is made when the receptacle 1 is in the state of a blank (visible in FIG. 20), at the location of a junction between the first back wall 7 and one of the first lateral walls 9, then the fin 25 becomes projecting at the time of the folding of the back wall 7 relative to the lateral wall 9, along their junction, while the receptacle 1 is formed into shape.

Figure 4:
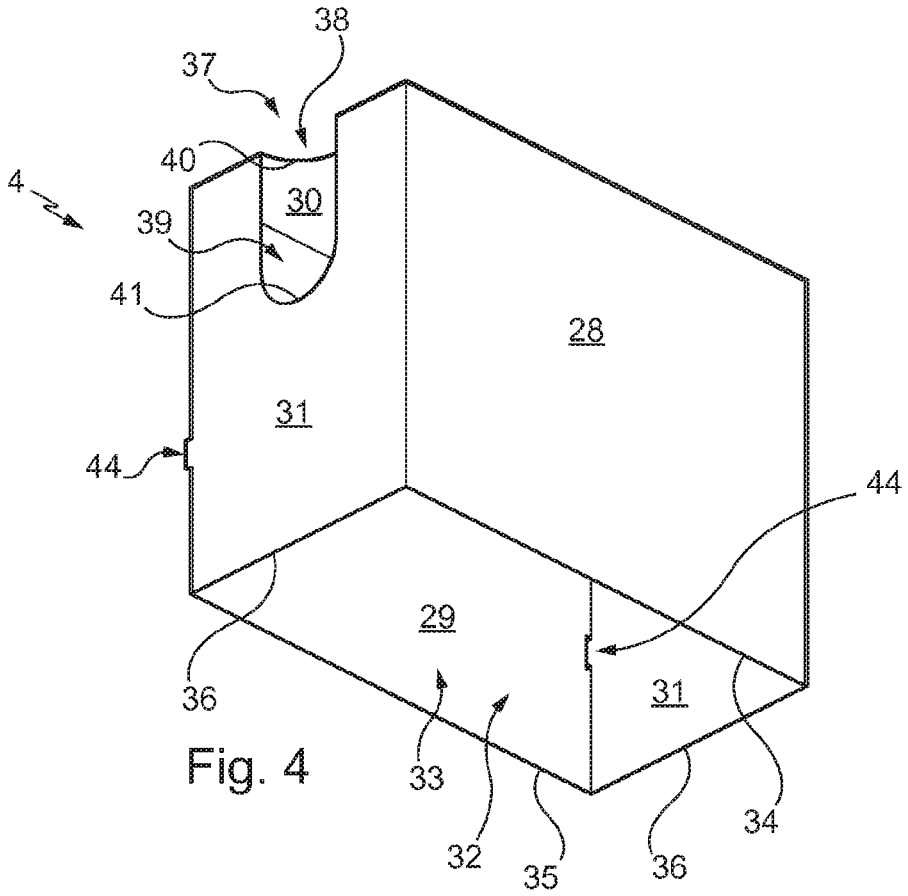
FIG. 4 illustrates, in perspective and in isolation, a cover-forming second part of the receptacle visible in FIG. 1.
Figure 5:
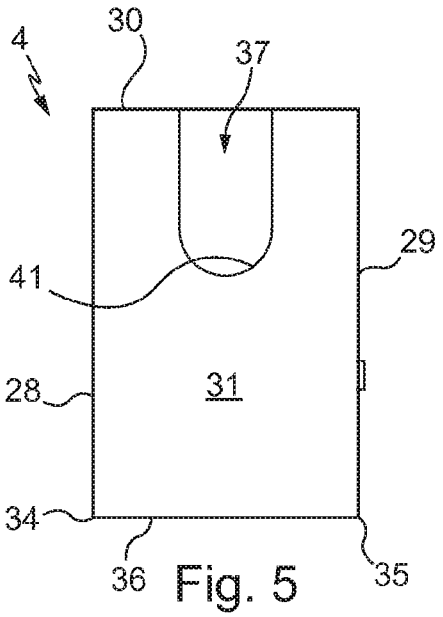
FIGS. 5 and 6 are plan views respectively of a lateral wall and of a back wall of the cover-forming second part visible in FIG. 4.
Figure 6:
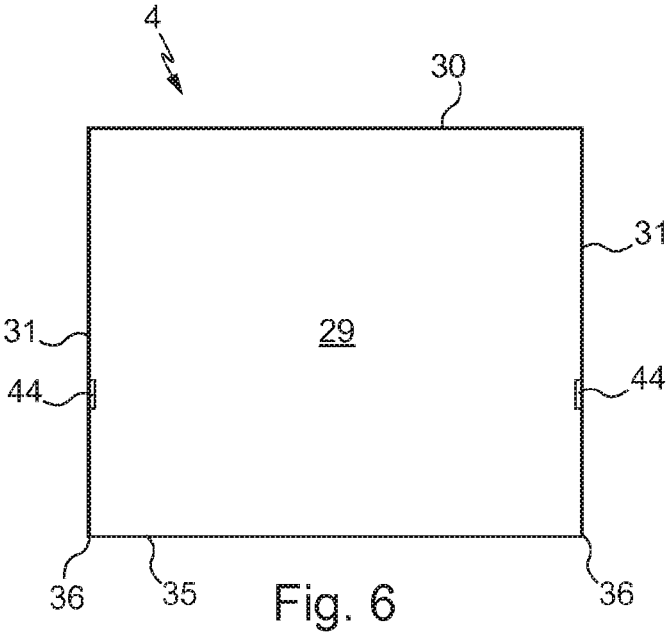

The second part 4 will now be described in more detail with reference to FIGS. 4 to 6.

The cover-forming second part 4 has a parallelepiped shape, here rectangular parallelepiped, and has a second front wall 28, a second back wall 29 opposite said second front wall 28, a second longitudinal wall 30 meeting the second front wall 28 and the second back wall 29, two second lateral walls 31 opposite each other and each meeting the second front wall 28, the second back wall 29 and the second longitudinal wall 30.

The second part 4 further comprises an internal space 32, delimited by the second front wall 28, the second back wall 29, the second longitudinal wall 30 and the second lateral walls 31, as well as an insertion opening 33 for the first part 3 into that internal space 32.

The second front wall 28, the second back wall 29 and the two second lateral walls 31 each respectively have a front free edge 34, a back free edge 35 and two lateral free edges 36 situated on the opposite side to the second longitudinal wall 30.

The back free edge 35 is situated opposite the front free edge 34 while the lateral free edges 36 are opposite each other and each meets the back free edge 35 and the front free edge 34.

The front free edge 34, the back free edge 35, and the two lateral free edges 36 together delimit the insertion opening 33.

The second part 4 is furthermore provided with two cut-outs 44 forming part of the device for locking in position the first part 3 relative to the second part 4 and each notch 44 is configured to cooperate with a respective projecting fin 25 of the first part 3.

Each notch 44 is formed here by an incision made in the second back wall 29, at the junction between the latter and one of the second lateral walls 31.

The cut-outs 44 are each situated at the same distance relative to the second longitudinal wall 30 and are opposite each other, at the same level on the second back wall 29.

The second part 4 furthermore has two first cut-outs 37, each being provided both in the second longitudinal wall 30 and in one of the two second lateral walls 31.

More specifically, each first cut-out 37 has a longitudinal portion 38 provided in the second longitudinal wall 30 and a lateral portion 39 provided in the second respective lateral wall 31.

The longitudinal portion 38 is delimited by a first U-shaped contour 40 having two opposite ends by each of which the first U-shaped contour 40 is connected to the junction between the second longitudinal wall 30 and the second respective lateral wall 31.

The lateral portion 39 is delimited by a second U-shaped contour 41 having two opposite ends by each of which the second U-shaped contour 41 is connected to the junction between the second longitudinal wall 30 and the second respective lateral wall 31.

The lateral portion 39 has an elongate shape and is longer than the longitudinal portion 38.

The first two cut-outs 37 are located opposite each other.

The second part 4 furthermore has a second cut-out 42 (visible in FIG. 7) entirely formed in the second longitudinal wall 30.

This second cut-out 42 is delimited by a circular third contour 43 and is here formed substantially at the center of the second longitudinal wall 30, in alignment with the first cut-outs 37.

A description will now be given in more detail of the obturating and opening configurations of the receptacle 1 with reference to FIGS. 7 to 10.

Figure 7:
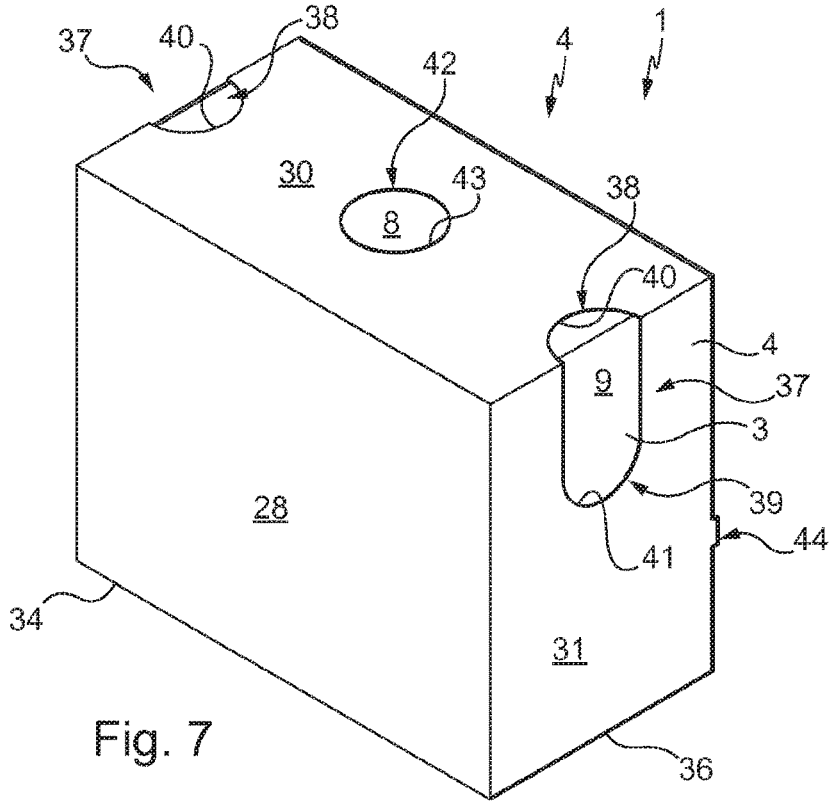
FIG. 7 illustrates the receptacle visible in FIG. 1, in the obturating configuration, in vertical position, and here without any straws.

In FIG. 7, the receptacle 1 is represented in its obturating configuration and in upright position, that is to say vertical.

In this obturating configuration of the receptacle 1, the first part 3 is fully inserted into the second part 4 such that the opening and the longitudinal strip of the first part 3 are concealed by the second front wall 28 of the second part 4. It is thus not possible to insert or remove straws 2 from the receptacle 1.

In the vertical position of the receptacle 1, the first longitudinal walls 8 of the first part 3 (only one of which is visible, only partly) and the second longitudinal wall 30 each extend in a respective substantially horizontal plane; while the first lateral walls 9 (only one of which is visible, partly only), the first front wall and the first back wall (not visible) of the first part 3, as well as the second lateral walls 31 (only one is visible), the second front wall 28 and the second back wall (not visible) each extend in a respective substantially vertical plane.

In this vertical position, the receptacle 1 rests on the first longitudinal wall 8 of the first part 3 which is to be found on the side at which are located the opening and the guide ramp (not visible) and on the front free edge 34, the back free edge (not visible), and the two lateral free edges 36 of the second part 4.

In the obturating configuration of the receptacle 1, the projecting fins (not visible) of the first part 3 are each inserted into a respective notch 44 of the second part 4 so as to lock the positioning of the first and second parts 3 and 4 relative to each other or, in other words, so as to prevent the first part 3 from sliding freely relative to the second part 4.

Inadvertent opening of the receptacle 1 is thus avoided and thus the transport of the straws 2 in the receptacle 1 is rendered convenient and secure.

In the obturating configuration, the lateral portion 39 of each first cut-out 37 is here fully or almost fully opposite a portion of the respective first lateral wall 9 of the first part 3; and the longitudinal portion 38 of each first cut-out 37 is here fully or almost fully opposite a portion of the first longitudinal wall 8 which is situated on the opposite side to the guide ramp and/or to the opening (not visible).

Figure 8:
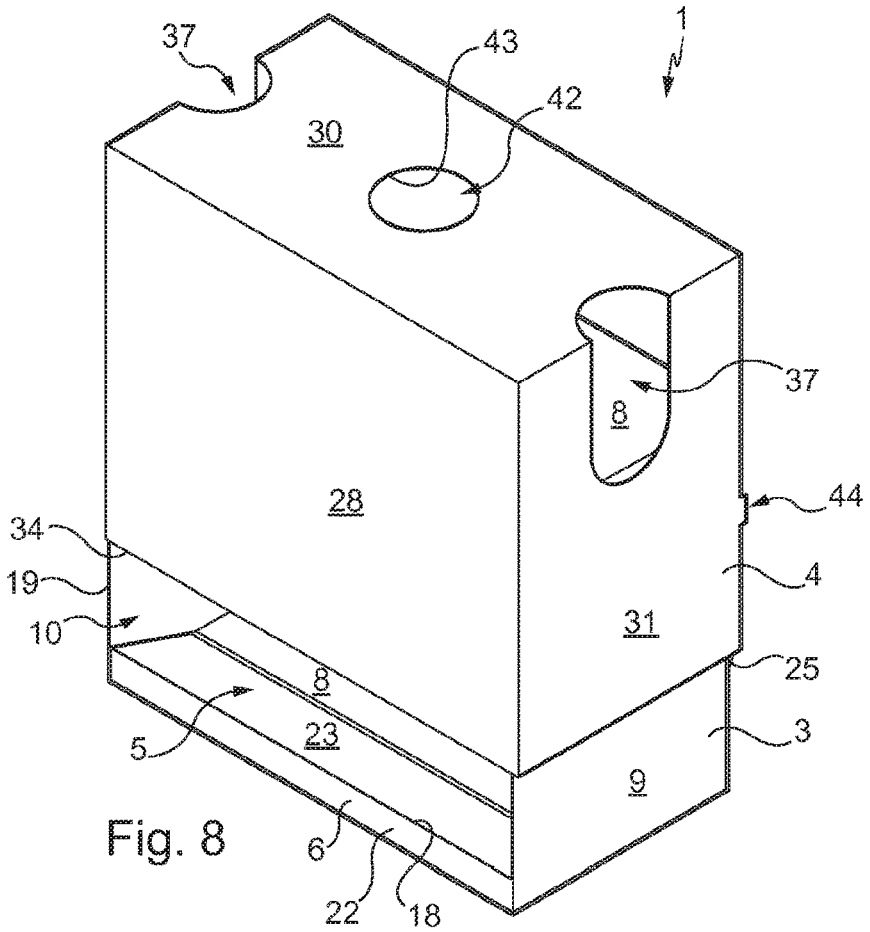
FIGS. 8 and 9 are views in perspective, from different viewing angles, of the receptacle visible in FIG. 7, here in an opening configuration in which the accommodation-forming first part is partially inserted into the cover-forming second part.
Figure 9:
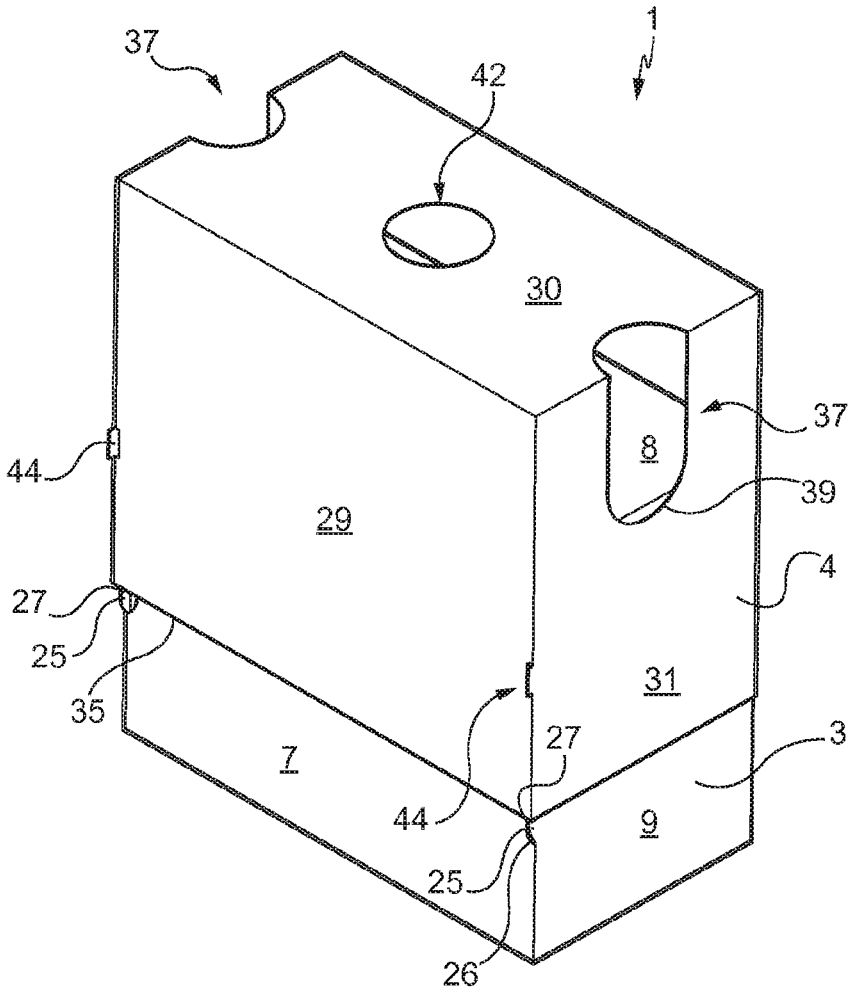

To pass from the obturating configuration to the opening configuration of the receptacle 1 which is visible in FIGS. 8 and 9, in which the first part 3 is partly inserted into the second part 4 (and thus partly withdrawn), a user may apply pressure, for example using a finger, on the first longitudinal wall 8 through the longitudinal portions 38 of the first cut-outs 37, so as to make the first part 3 of the receptacle 1 slide relative to its second part 4, through the insertion opening 33 of the latter, and thus so as to move that first longitudinal wall 8 away from the second longitudinal wall 30.

The user may also make use of the second cut-out 42 to press on the first part 3 and/or to hold the second part 4.

The position of the first and second cut-outs 37 and 42 enables the user to use only one hand both to hold the second part 4 and apply pressure on the first part 3 through the first cut-outs 37.

The sliding of the first part 3 relative to the second part 4 of the receptacle 1 can only occur if the user applies sufficient pressure first of all to extract the projecting fins 25 from the cut-outs 44 and thereby leave a locked position.

This extraction is facilitated by the curved portions 26 of the fins 25 which make it possible to disengage them from the cut-outs 44 without the fin 25 and the cut-outs 44 being deteriorated.

In the opening configuration illustrated in FIGS. 8 and 9, the receptacle 1 is in vertical position and here rests only on the first longitudinal wall 8 of the first part 3 which is located on the side at which are situated the opening 5 and the guide ramp 22.

A portion of the first part 3 which comprises the longitudinal strip 10 and the opening 5 projects out from the internal space 32 of the second part 4, such that neither the longitudinal strip 10 nor the opening 5 (at least in part) are concealed by the second front wall 28 of the second part 4.

The opening 5 is thus accessible here, at least partially, for the insertion and withdrawal of straws 2.

It will be noted that the inclined portion 23 of the guide ramp 22, in vertical position of the receptacle 1 makes it possible to keep the straws 2 at least temporarily and partially in the internal space 24 of the first part 3.

The opening 5 is formed here entirely by the recess-forming longitudinal strip 10 and is provided in the front wall 6 of the first part 3, between the first longitudinal edge 18 and the second longitudinal inside edge (not visible) of the first front wall 6.

It will be noted that the arrangement of the straight portions 27 of the projecting fins 25 relative to the arrangement of the second longitudinal inside edge (not visible) of the first front wall 6, i.e. that it is located at the same height relative to the horizontal plane defined by the first longitudinal wall 8 which is located on the side at which are situated the opening 5 and the guide ramp 22, means that the front free edge 34 of the second front wall 28 of the second part 5 is located opposite the second longitudinal inside edge (not visible) of the first front wall 6; such that the opening 5 is also here formed, or delimited, by the first longitudinal inside edge 18 of the first part 3 and by the front free edge 34 of the second front wall 28.

As a variant, the opening 5 may be delimited by the first longitudinal inside edge 18 of the first part 3 and by the front free edge 34 of the second front wall 28, without the latter being located opposite the second longitudinal inside edge (not visible) of the first front wall 6.

In this opening configuration of the receptacle 1 in which the first part 3 is partly inserted into the second part 4, the back free edge 35 of the second back wall 29 of the second part 4 rests on the straight portions 27 of the projecting fins 25.

Thus, the second part 4 is held in position relative to the first part 3 and are not subject to the risk of sliding downwards and inadvertently obturating the opening 5.

This opening configuration of the receptacle 1 in which the first part 3 is partly inserted into the second part 4 in particular makes it possible, as will be described later, to dispose the receptacle 1 containing straws 2 in a supply hopper of a processing machine for straws.

In a variant not illustrated, the second part may be provided with at least one other additional notch, for example provided near its back free edge 35, to receive at least one of the projecting fins to hold in position, in locked manner, the first part 3 partly inserted into the second part 4.

In this opening configuration of the receptacle 1 in which the first part 3 is partly inserted into the second part 4, the lateral portion 39 of each first cut-out 37 is partly opposite only a small portion of the first respective lateral wall 9 of the first part 3, such that the first longitudinal wall 8 opposite the second longitudinal wall 30 is located substantially at the location of the back of the U of the first respective cut-outs 37.

In other words, the lateral portion 39 of each cut-out 37 has a length slightly greater than the distance separating the straight portion 27 of the fins 25 from the horizontal plane defined by the first longitudinal wall 8 which is located on the side at which are situated the opening 5 and the guide ramp 22.

Figure 10:
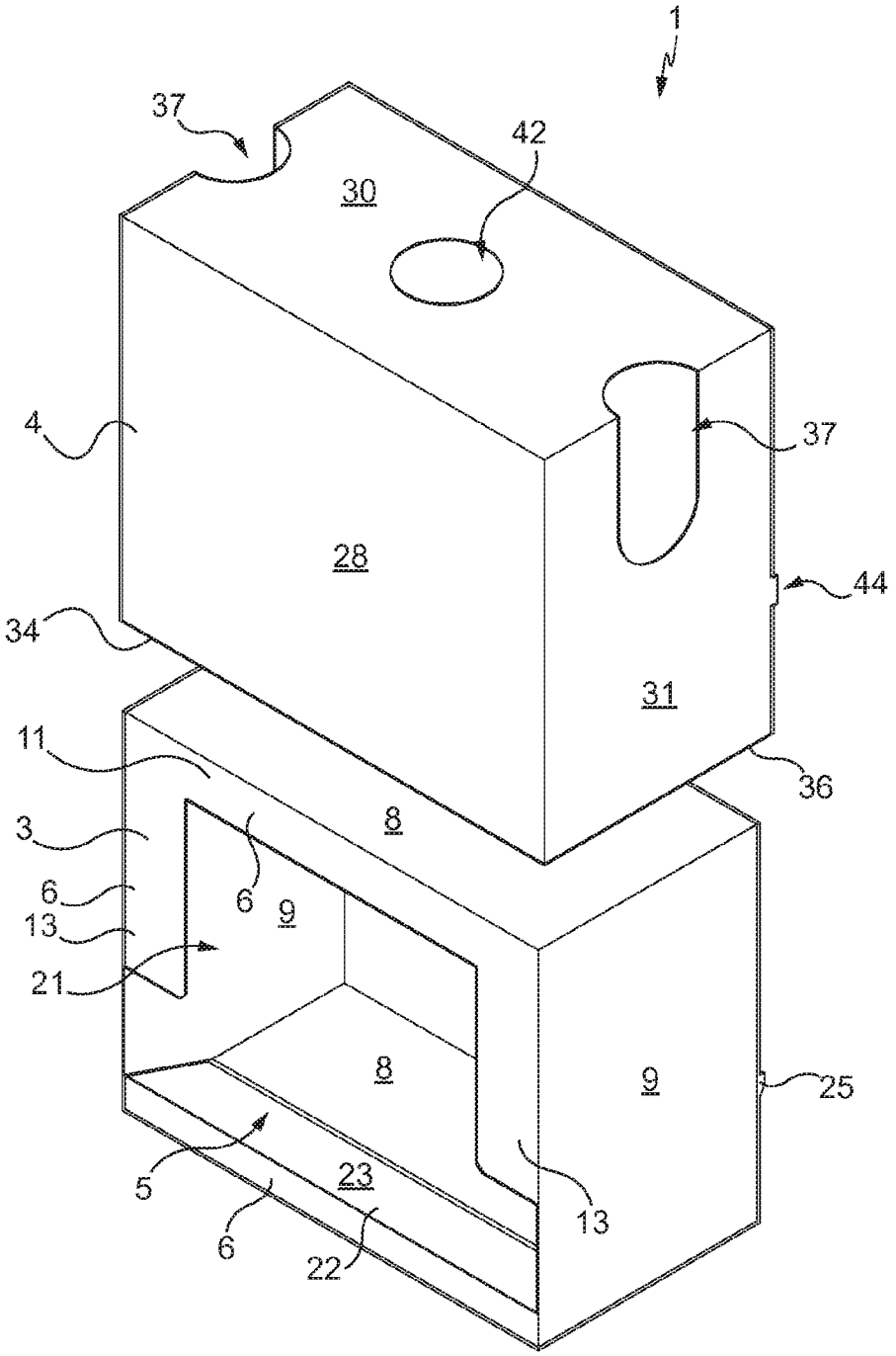
FIG. 10 is a perspective view similar to that of FIG. 8, here in the opening configuration in which the accommodation-forming first part is separate from the cover-forming second part.

FIG. 10 illustrates the receptacle 1 in another opening configuration, in which the accommodation-forming first part 3 is fully withdrawn and thus separated from the cover-forming second part 4.

In this configuration, the front free edge 34, the back free edge (not visible), and the lateral free edges 36 (only one is visible) of the second part 4 are at a distance from the first longitudinal wall 8 of the first part 3 which is opposite that which is located on the side at which are situated the opening 5 and the guide ramp 22.

In this configuration, not only is the opening 5 accessible, but this is also the case for the cut-out 21 made in the first front wall 6 of the first part 3.

Nevertheless, even in this configuration, the complete and fast pouring of the straws 2 is not automatic since these latter are temporarily retained in the internal space 24 of the first part 3 in particular by the lateral strips 13 of the U-shaped portion 11 of the first front wall 6 against which the straws 2 bear at least partially; and by the inclined portion 23 of the guide ramp 22.

A description will now be given with reference to FIGS. 11 to 19 of the processing installations for straws comprising at least one processing machine for straws and the receptacle 1.

Figure 11:
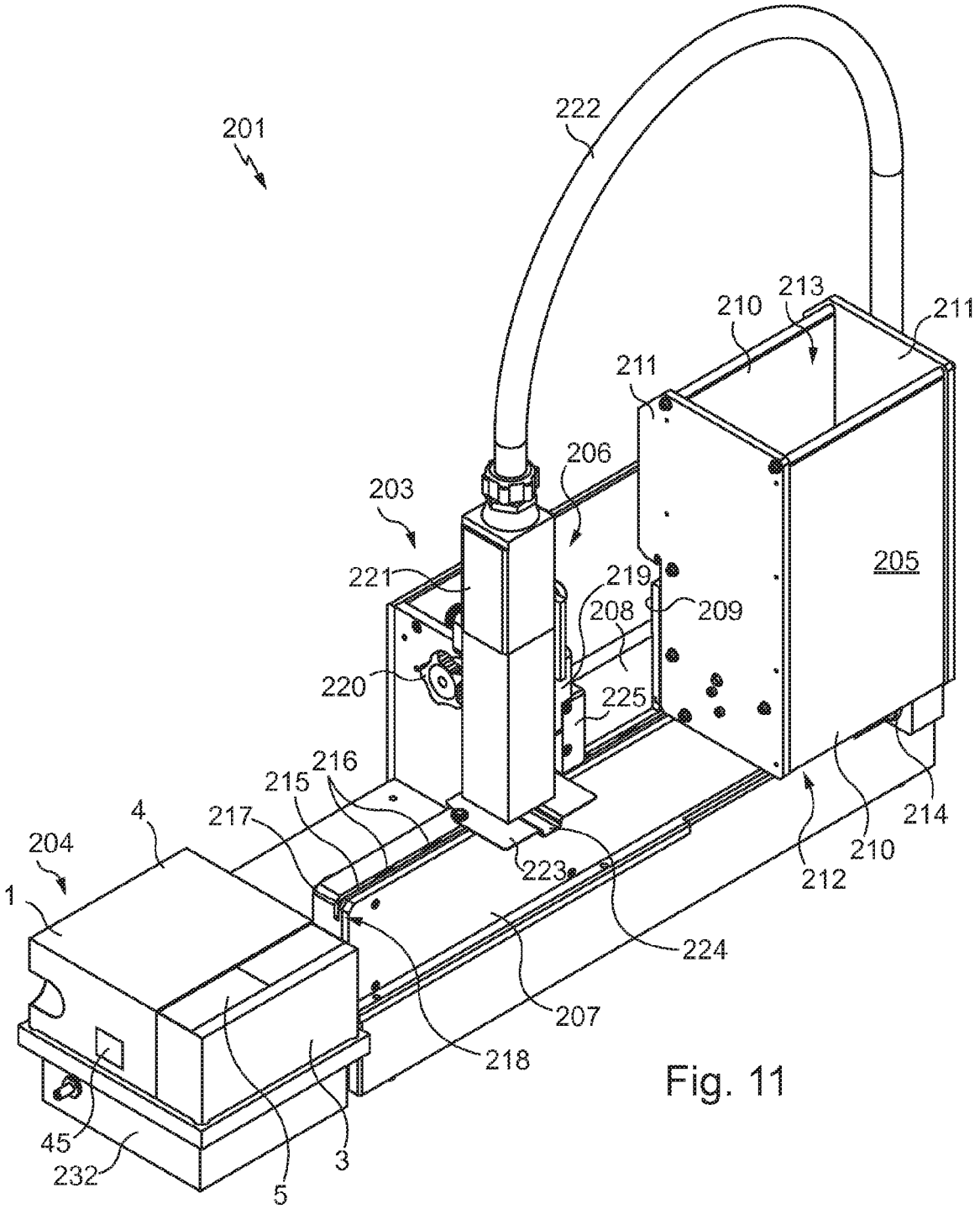
FIG. 11 is a diagrammatic illustration in perspective of a processing installation, in particular for printing, of straws for packaging animal semen, comprising a first processing machine and the storage receptacle visible in FIGS. 1 to 10, here in horizontal position and in opening configuration in which the accommodation-forming first part is partially inserted into the cover-forming second part.

FIG. 11 illustrates an installation 201 for processing straws 2 which is here an installation for printing straws, comprising a processing machine 203, here a printing machine for straws, as well as a device 204 for at least temporary storage of the straws 2, which is disposed at an exit from the processing machine 203.

The step of printing straws 2 is characterized by the fact of applying predefined marking (not shown) to each straw, for example identification marking having in particular a reference to a batch number for straws, the origin and/or destination of the animal semen, etc.

The printing machine 203 comprises, at an entry, a supply hopper 205 for the straws 2, a printing unit 206 configured to apply the predefined marking to each straw 2 and a conveyor device 207 for conveying the straws 2 from the supply hopper 205 to the printing unit 206, and also from the printing unit 206 to an exit from the printing machine 203, where the straws are ejected in a predetermined orientation to be received in the storage device 204.

The printing machine 203 further comprises a frame 208 having a mounting plate 209 on which is securely attached the supply hopper 205.

The supply hopper 205 comprises two longitudinal walls 210 opposite each other, two lateral wall 211 opposite each other and each meeting the two longitudinal walls 210, as well as an inclined bottom wall 212 meeting each of the longitudinal 210 and lateral 211 walls.

The supply hopper 205 thus has a cavity 213 delimited by the longitudinal 210 and lateral 211 and bottom 212 walls and is configured to receive the straws 2 for their positioning on the conveyor device 207.

The supply hopper 205 is fastened to the mounting plate 209 by one of its lateral walls 211 and further comprises an evacuation system for the straws 2, situated substantially at the junction between the bottom wall 212 and the lateral wall 211 fastened on the mounting plate 209, and configured to deposit the straws, one by one, on the conveyor device 207, for them to be conveyed to the printing unit 206.

The printing machine 203 further comprises a stirring system 214 for the straws 2, adjacent to the supply hopper, and having members for imparting movement (not shown) configured to cooperate with the straws 2 in the cavity 213 of the supply hopper 205.

The conveying device 207 is formed by a groove 215 provided longitudinally in a body of the frame 208 and forming an accommodation for the straws 2.

The conveying device 207 is furthermore formed by roller wheels 216 accommodated in the groove 215 and disposed in a regular arrangement along that groove 215 between the entry and the exit of the printing machine 203.

The conveying device 207 comprises a rotational drive mechanism for the roller wheels 216 to enable the conveyance of the straws 2 when they are located in the accommodation.

The conveying device 207 further comprises, at one end 218 of the groove 215, at an exit of the printing machine 203, a wheel 217 mounted with freedom to rotate in the groove 215 and configured to hold the straws 2 in their predetermined orientation when they are ejected from the groove 215, for being received in the storage device 204.

The printing unit 206 comprises a mounting 219 having a fixed part securely mechanically connected to the frame 208 of the printing machine 203, and a movable part (not visible in the figures) configured to be movable relative to the fixed part under the action of an adjustment wheel 220 of the mounting 219.

The printing unit 206 further comprises a printing head 221 fastened to the movable part of the mounting 219 so as to be adjustable in position, and a cord 222, also called umbilical cord, configured to supply in particular the printing head with ink to apply the marking to the straws 2.

The printing unit 206 further comprises an inkwell 223 disposed on the frame 208 and interposed between the printing head 221 and the groove 215.

The inkwell 223 is provided with a channel 224 disposed transversely to the groove 215 and which interrupts it partially.

This channel 224 has two through apertures (not visible in the drawings) opposite each other and situated along the longitudinal axis of the groove 215, so as to form a passage for the straws 2 through the inkwell 223.

It will be noted that the printing head 221 is disposed in vertical alignment with the channel 224 of the inkwell 223, at the location of the groove 215 in which pass the straws 2, and is adjustable in position for the printing thereof.

It will be noted that the inkwell 223 is configured here to allow the straws 2 to pass and to enable their printing, while protecting the roller wheels 216 which are located in portions of the groove 215 in the immediate vicinity of the printing head 221, from possible ink splatter.

The printing head 206 further comprises a sensor 225 configured to detect the presence of the straws in the groove 215, immediately upstream of the inkwell 223 and thus of the printing head 221, in particular to enable the triggering of the printing.

It will be noted that the receptacle 1 further comprises here an identification medium 45, here disposed on its second part 4, configured to encode information identifying the straws 2 stored in the receptacle 1, while the printing machine 203 comprises a control-command unit (not illustrated) configured to retrieve the information encoded in the identification medium 45 and to control and command the printing machine 203 according to the information retrieved.

The identification medium 45 may for example encode a batch number which will be retrievable by the control-command unit and printed by the printing unit 206 on each of the straws 2 before storing them in the receptacle 1.

The identification medium 45 may for example be a one-dimensional, two-dimensional or even three-dimensional barcode, printed on the receptacle 1, while the control-command unit is provided with an image capture device to take a photograph of the barcodes; or the identification medium 45 may be an RFID or NFC chip, while the control-command unit is provided with an RFID or NFC chip reader.

The storage device 204 is situated in a predetermined position at an exit of the printing machine, opposite the end 218 of the groove 215, from which are ejected the straws 2, so as to receive them for their storage, which is at least temporary.

The storage device 204 comprises the receptacle 1 having the passage opening 5 for the straws 2 formed at least partly in the first part 3 of the receptacle, extending at least in a longitudinal direction corresponding to the predetermined orientation of the straws 2 when they are ejected, as well as a system 232 for imparting movement configured to drive the receptacle 1, transversely to the longitudinal direction of the opening 5, in a back-and-forth movement between a first position and a second position (not illustrated) at a distance from the first position.

The straws 2 received in the receptacle 1 are made to move relative to each other to be disposed in an organized state in the receptacle 1.

Figure 12:
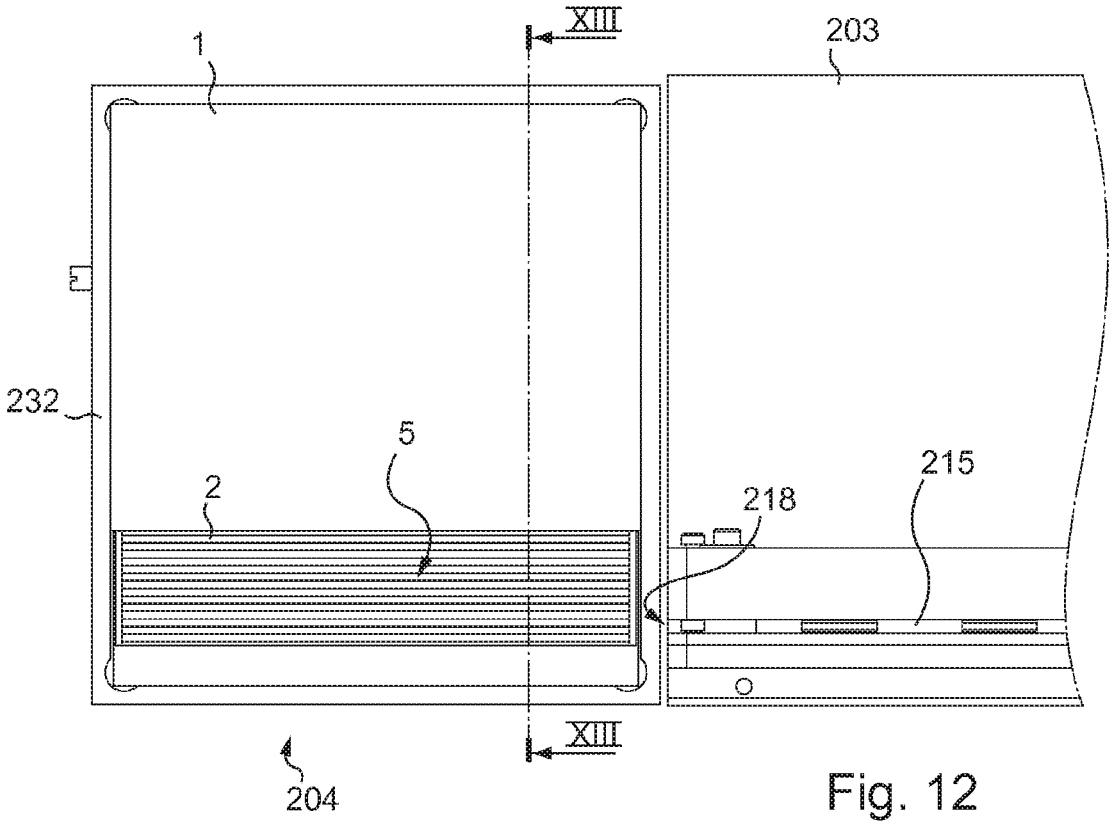
FIG. 12 partially illustrates the installation of FIG. 11, in a view from above.

FIG. 12 shows the receptacle 1 in its first position (its second position is not illustrated). The first and second positions are located here in the same horizontal plane. The storage device 204 is configured to enable reception of the straws 2 in the receptacle 1, both in its first position and in its second position.

In each of these first and second positions, the end 218 of the groove 215 is located opposite the opening 5 of the receptacle 1 to enable the straws 2 to fall into the receptacle 1, through the opening 5, whether or not the receptacle 1 is moved by the system 232 for imparting movement.

The back-and-forth moment is periodic here, with a period for example comprised between 0.1 second and 1 second, and of amplitude for example comprised between 5 millimeters and 20 millimeters. These examples of values are of course dependent upon the dimensions of the opening 5, upon the dimensions of the straws 2 for example in terms of length and diameter, and even upon the exit velocity of the straws 2 and the relative position of the receptacle 1 relative to the printing unit 206.

Figure 13:
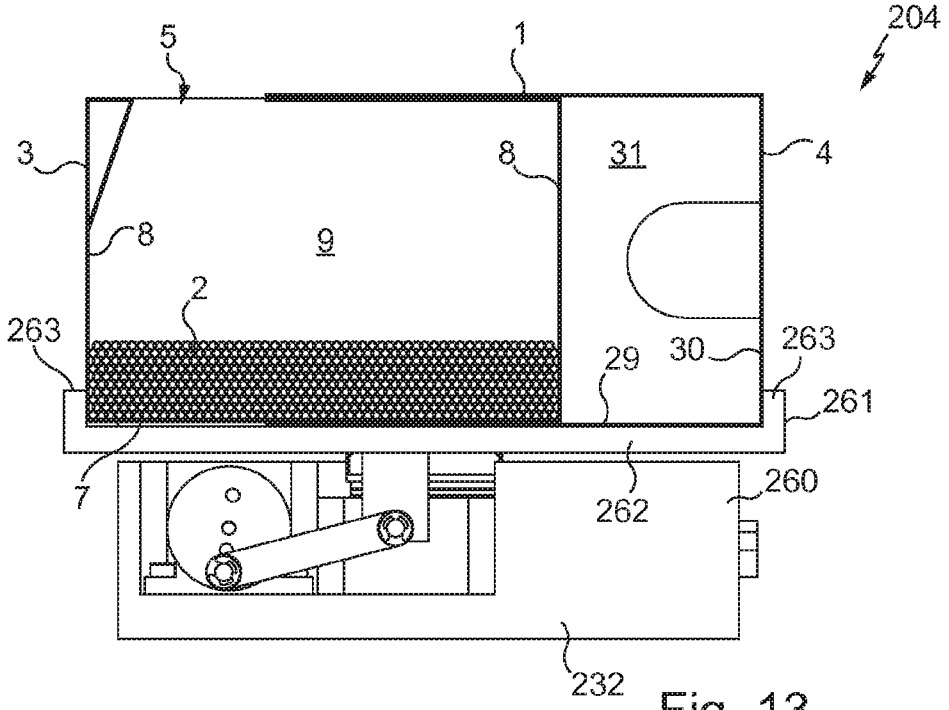
FIG. 13 is a cross-section view of the receptacle on XIII-XIII of FIG. 12.

With reference to FIG. 13 a description will now be made of the system 232 for imparting movement.

The system for imparting movement 232 comprises a base 260 and a plate 261 which is movable relative to the base 260.

The plate 261 is configured to support the receptacle 1 in a predetermined fixed position.

The plate 261 has a bottom wall 262 which is planar, two longitudinal rims 263 opposite each other and projecting from the bottom wall 262, and two lateral rims (not illustrated) opposite each other, projecting from the bottom wall 262, and each meeting the two longitudinal rims 263.

The lateral and longitudinal rims 263 form, together with the planar bottom wall 262, a reception space configured to partially accommodate the receptacle 1.

In the filling configuration, the single second longitudinal wall 30 of the second part 4 of the receptacle 1 comes to abut one of the longitudinal rims 263, each lateral wall 31 of the second part 4 and a portion of each first lateral wall 9 of the first part 3 come to abut one of the lateral rims 263, one of the two first longitudinal walls 8 of the first part 3 comes to abut the other of the longitudinal rims 263, and the second back wall 29 of the second part 4 and a portion of the first back wall 7 of the first part 3 come to abut the planar bottom wall 262.

In the filling configuration, the receptacle 1 is thus not free to move within the reception space of the plate 261, even when it is made to move.

FIGS. 14 to 19 illustrate a processing installation 301 for straws which here is an installation for the filling and the welding of the straws 2, and comprises a processing machine 303, here a machine for filling and welding straws 2, a movable support 304 configured to convey the straws 2 to the filling and welding machine 303, as well as a device 305 for supply and positioning of straws 2 on the movable support 304 for the purpose of the filling and welding of the straws 2.

The processing machine 303, the movable support 304 and the supply and positioning device 305 are mounted on a frame 306 of the installation 301.

The filling and welding machine 303 comprises a pump mechanism 307, provided in particular with a vacuum pump, filling nozzles 308 mounted on a first movable carriage 309, suction nozzles 310 mounted on a second movable carriage 311 which is disposed opposite the first movable carriage 309, and with a reservoir of animal semen 312.

The filling nozzles 308 and the suction nozzles 310 are configured to cooperate with the straws 2 and to enable their filling.

The filling nozzles 308 and the suction nozzles 310 are mounted on the first and second movable carriages 309 and 311 to be movable parallel to the length of the straws 2 between an advanced filling position and a withdrawn position.

The filling and welding machine 303 further comprises a welding station 313 configured to weld the ends of the straws 2 after filling.

Figure 14:
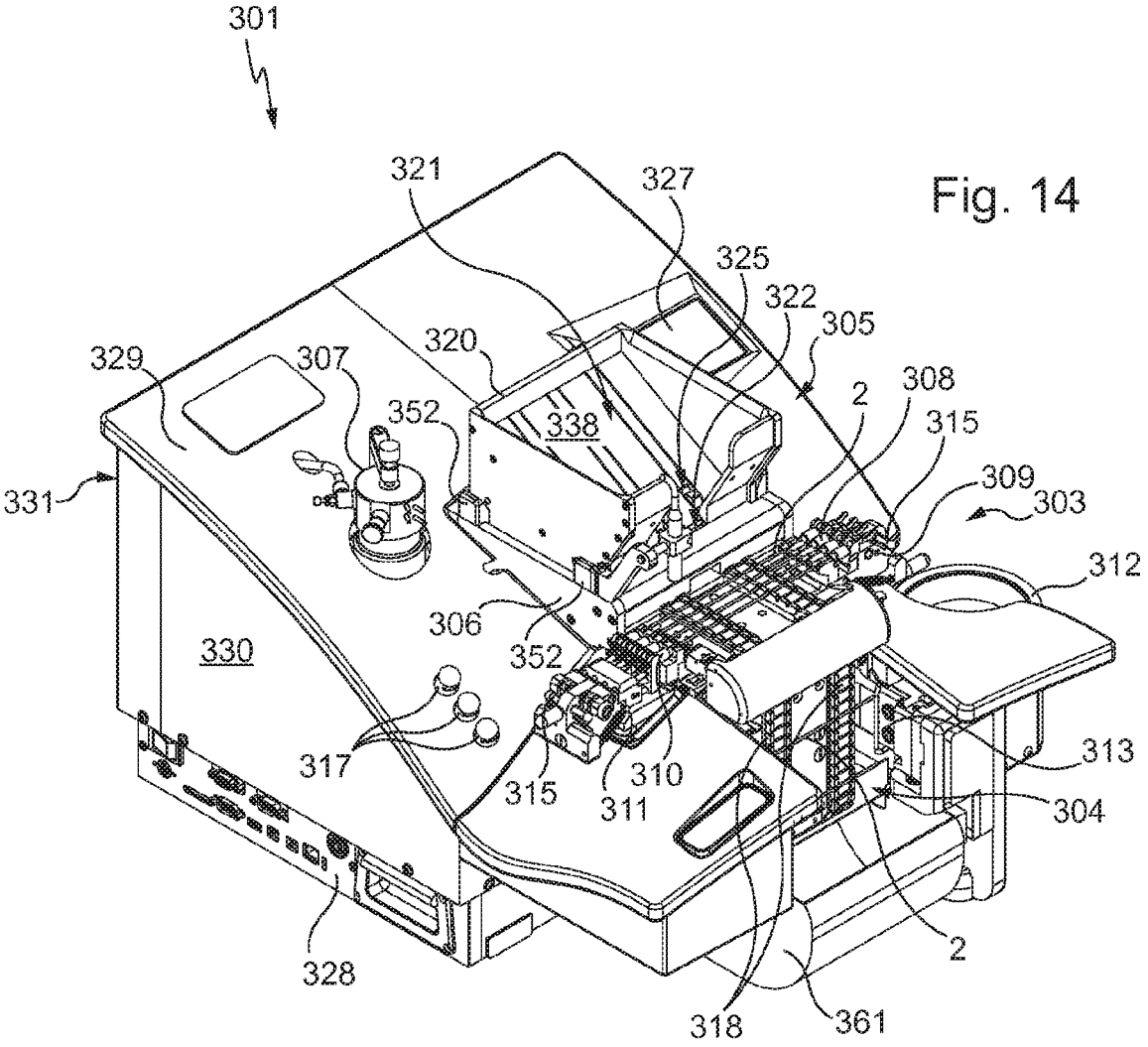
FIG. 14 is a diagrammatic illustration in perspective of another processing installation, in particular for filling and welding, of straws for packaging animal semen, comprising a device for supply and positioning, a movable support and a second processing machine.

More specifically, FIG. 14 shows the straws 2 in course of cooperation with filling nozzles 308 and suction nozzles 310.

Before filling, the stopper of each straw 2 is disposed in the neighborhood of a first of the ends of the tube of the straw 2 and it is provided that in the filled state, the dose of animal semen which must be preserved in the straw 2 is disposed between the stopper and a second of the ends of the tube which is the furthest from the stopper.

To fill each straw 2, the first end of the tube is placed in communication by virtue of the suction nozzle 310 with the pump mechanism 307 whereas the second end is placed in communication by virtue of the filling nozzle 308 with the reservoir containing the semen to introduce into the tube of the straw 2.

The air initially contained between the stopper of the straw 2 and the second end is sucked through the stopper whereas the semen progresses within the tube of the straw 2 until it encounters its stopper.

The filling nozzle 308 comprises a needle 314 (visible in FIG. 17) connected to the reservoir via a flexible pipe (not shown) connected to a connector tip of the filling nozzle 308.

The suction nozzle 310 comprises a needle 316 connected to the pump mechanism 307 via a flexible pipe (not shown) connected to a connector tip of the suction nozzle 310.

The filling and welding machine 303 further comprises pinch members 315 for pinching each of the flexible pipes enabling the fluidic communication to be interrupted or authorized between the needle 314 and the reservoir 312 and between the needle 316 and the pump mechanism 307.

It will be noted that the first and second movable carriages 309 and 311 are each provided with several filling nozzles 308 and suction nozzles 310 to enable the filling of several straws 2 at the same time.

The pinch members 315 are configured to interrupt or allow, at the same time, the fluidic communication of all the pipes connected to the filling nozzles 308 and suction nozzles 310.

The filling and welding machine 303 further comprises solenoid valves 317 configured to shunt at least one of the suction nozzles 310, by pinching the flexible pipe linking it to the pump mechanism 307.

Once the straws 2 are in the filled state, they are conveyed to the welding station 313 and are welded in the neighborhood of the second end of the tube, or even also in the neighborhood of the first end of the tube, then they are collected for cold storage.

The movable support 304 is formed by two conveyor belts 318 each having a plurality of grooves forming accommodations 319 (visible in particular in FIG. 17) that are configured to receive the straws 2 in a predetermined orientation.

The movable support 304 is configured to convey the straws 2 thus accommodated on the latter, from the supply and positioning device 305 to the filling and suction nozzles 308 and 310 for filling the straws 2, then from these nozzles to the welding station 313 for welding of the straws 2.

The supply and positioning device 305 comprises a supply hopper 320 having an internal space 321 configured to receive a plurality of straws 2, as well as an evacuation channel 322 comprising an entry aperture 323 (visible in FIGS. 15, 18 and 19) opening into the internal space 321 of the supply hopper 320 and an exit aperture 324 (visible in FIGS. 16, 18 and 19) configured to be opposite accommodations 319 of the movable support 304.

The supply hopper 320 is furthermore configured to receive the receptacle 1 (visible in FIGS. 18 and 19) for the emptying thereof. To supply the machine with straws 2, the receptacle 1, then in obturating configuration, can be inserted into the hopper 320, then passed into its opening configuration in order for the straws 2 to pour into the hopper 320 (see hereinafter).

The filling and welding machine 303 may comprise a control-command unit (not illustrated), similar to that of the printing machine described above, and configured to retrieve the information encoded in the identification medium of the receptacle 1 and to control and command that machine according to the information received.

The supply and positioning device 305 here further comprises a separator system 325 configured to impart movement to the straws 2 in the internal space 321 of the supply hopper 320.

The insulation 1 further comprises a container 361 for collecting the straws 2 after filling and welding thereof, a control-command screen 327 connected to a control-command unit (not shown) of the installation 1, for the implementation in particular of the steps of filling and welding the straws 2, as well as a supply and connection block 328 having an interface provided with a plurality of ports for information technology and electrical connection which are connected in particular to the control-command unit.

The frame 306 of the installation 1 is at least partly covered with adorning panels, here formed in particular by a front panel 329, two lateral panels 330 (only one of which is visible in FIG. 14), and a rear panel 331.

Figure 15:
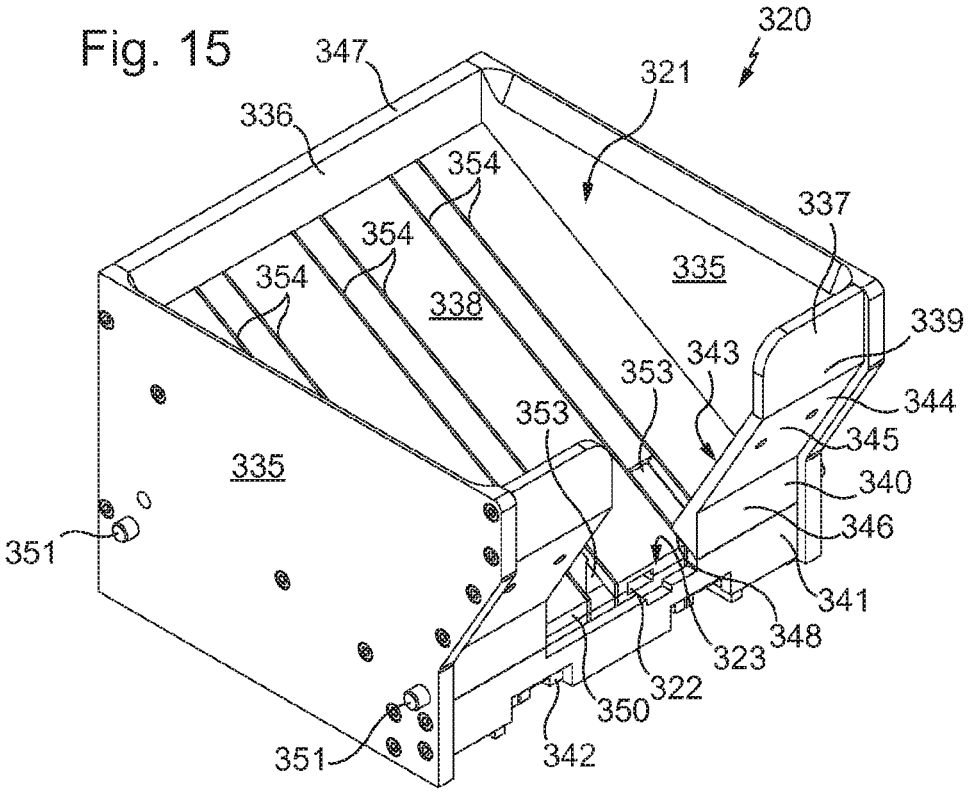
FIGS. 15 and 16 are perspective illustrations from two different viewing angles of a supply hopper of the supply and positioning device, taken in isolation.
Figure 16:
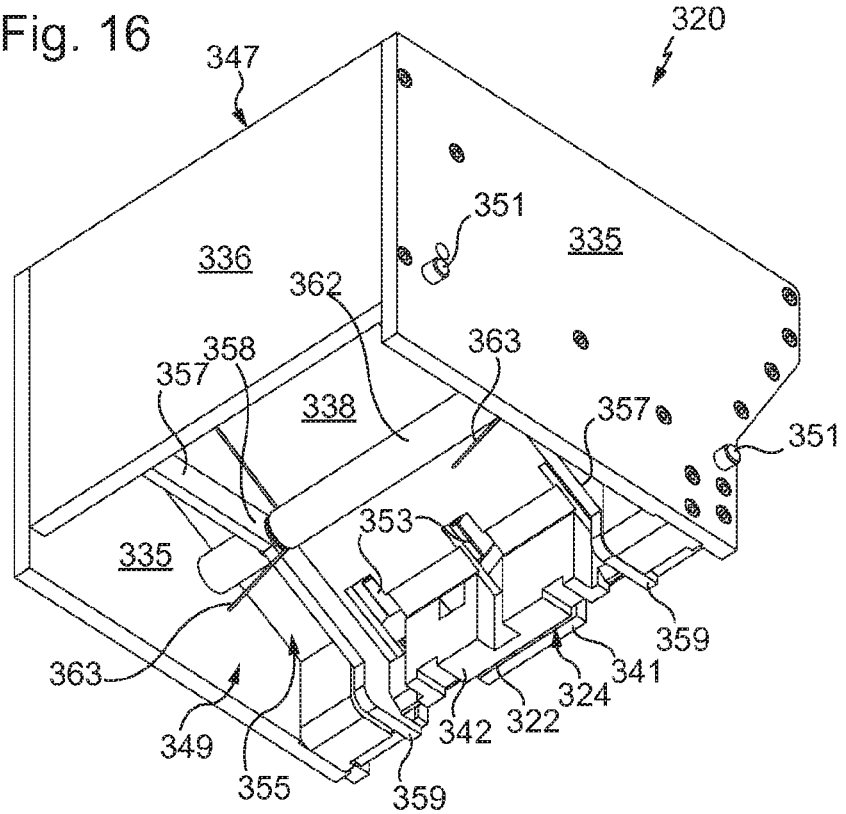

The supply hopper 320 comprises two lateral walls 335 opposite each other, a rear wall 336 meeting the two lateral walls 335, a front wall 337 opposite the rear wall 336 and also meeting the two lateral walls 335, as well as an inclined bottom wall 338 meeting each of the lateral walls 335 and rear wall 336 (see FIGS. 15 and 16).

The internal space 321 of the supply hopper 320 is delimited at least partly by each of the lateral walls 335, front wall 337, rear wall 336 and bottom wall 338.

The inclined bottom wall 338 is produced at least partly from electrically conducting material.

The lateral walls 335, the front wall 337 and the rear wall 336 are here also formed from electrically conducting material.

The supply hopper 320 further comprises at least one removable spacer 383, configured to be mounted in its internal space 321, on its front wall 337.

Figure 18:
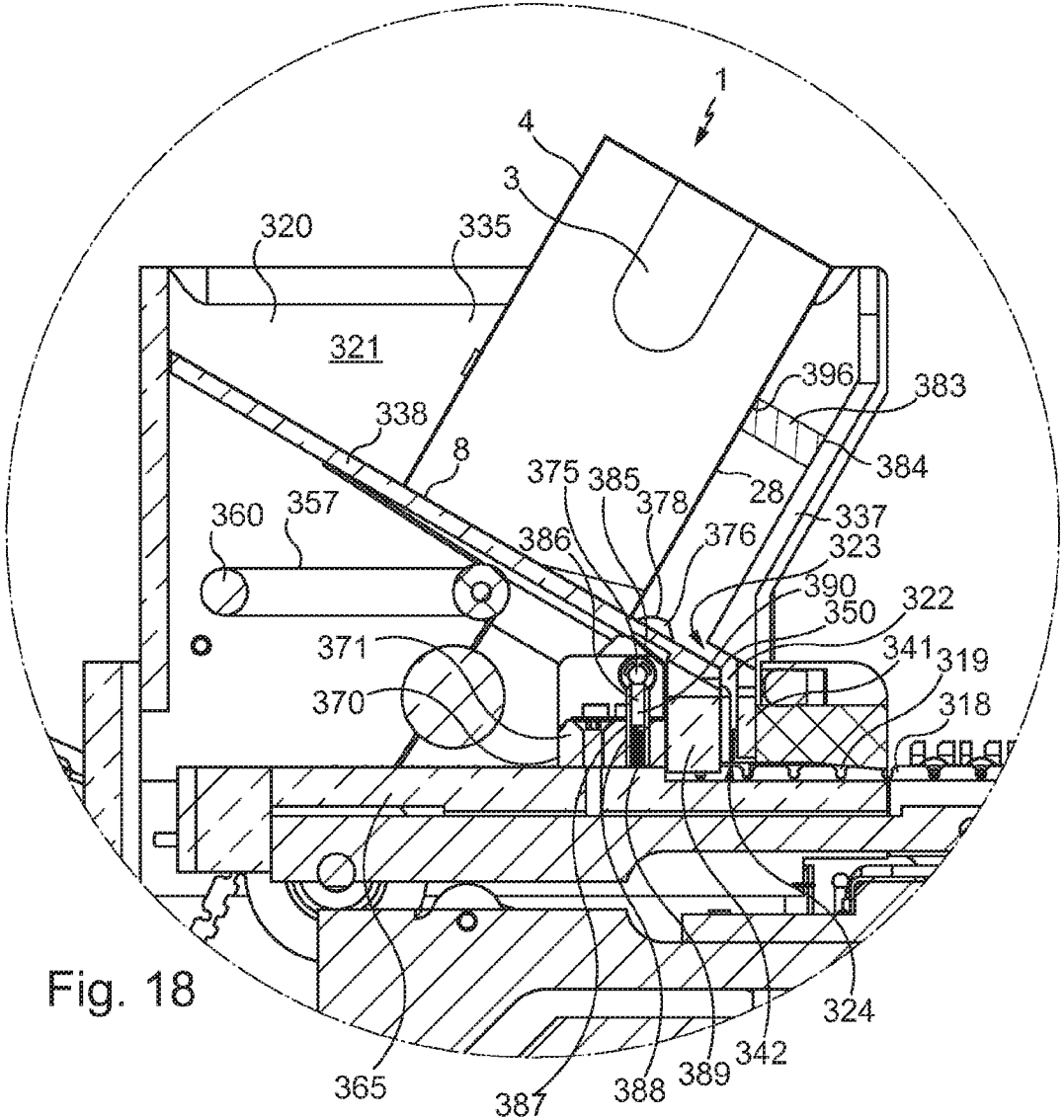
FIGS. 18 and 19 are views in medial cross-section partially showing the installation visible in FIG. 14, with the storage receptacle visible in particular in FIGS. 1 to 10 disposed in the supply hopper, here in inclined vertical position, respectively in obturating configuration wherein the accommodation-forming first part is inserted into the cover-forming second part and in opening configuration wherein the accommodation-forming first part is partially inserted into the cover-forming second part.
Figure 19:
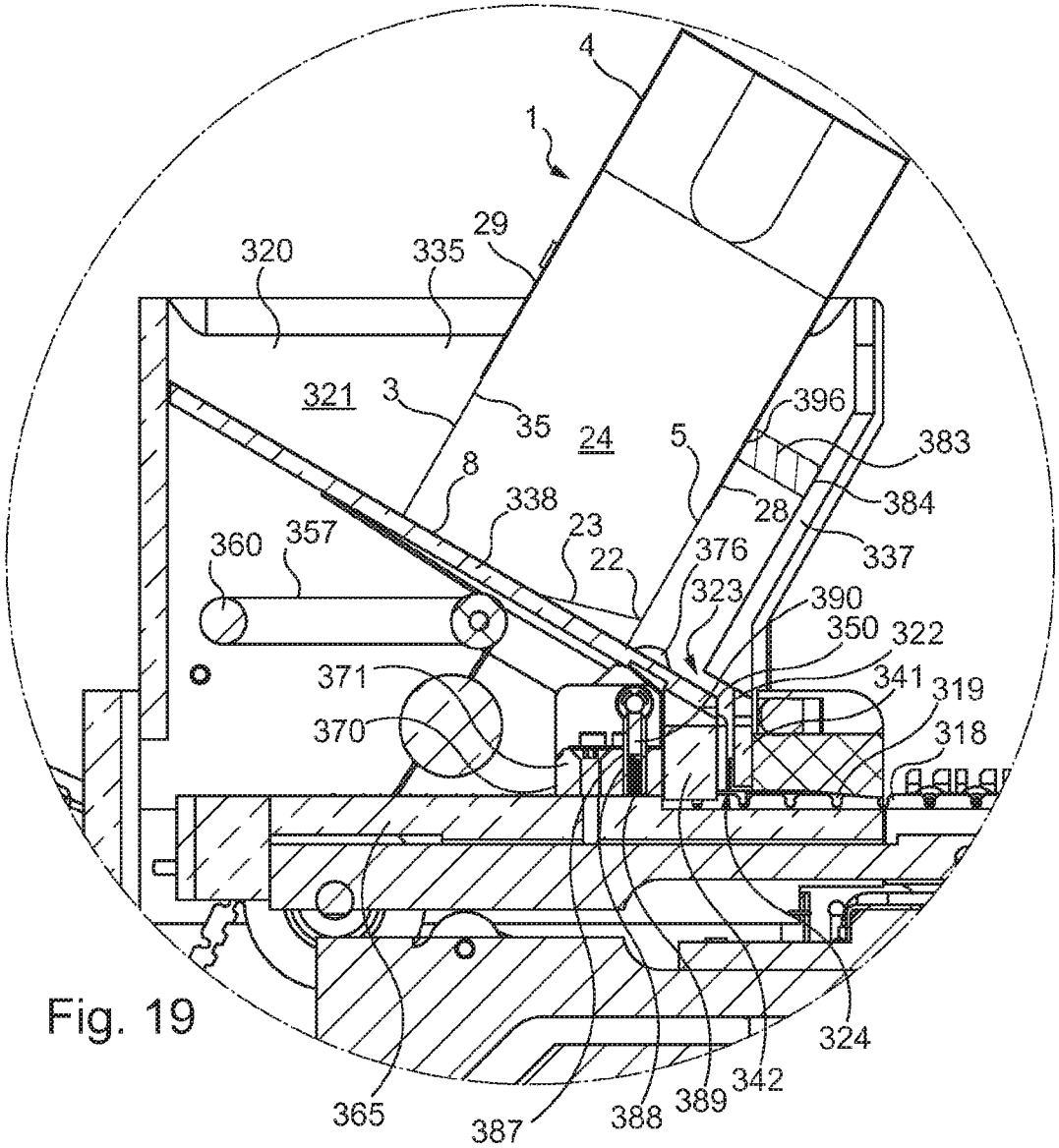

The spacer 383 is of substantially parallelepiped shape and comprises a mounting face 384, by which the spacer 383 is mounted on the front wall 337, and a resting face 396, which is an opposite face to the mounting face 384, configured to form a rest for the first front wall 6 or for the second front wall 28 of the receptacle 1 when the latter is received in the hopper 320 (see FIGS. 18 and 19).

The supply hopper 320 further comprises a first flange 341 disposed consecutively to the front wall 337 as well as a second flange 342 disposed opposite the first flange 341 under the inclined bottom wall 338

The supply hopper 320 is removable and has positioning feet 351 provided projecting from each of the lateral walls 335.

The supply and positioning device 305 further comprises a hopper support formed by a plurality or reception pillars 352 (visible in FIGS. 14 and 17) which are fastened to a U-shaped base 356 of the frame 306 of the installation and are configured to cooperate with the positioning feet 351 of the supply hopper 320; so as to position it in a predetermined position.

The lateral walls 335 and the rear wall 336 are substantially planar here; whereas the front wall 337 is provided with a first vertical portion 339 and with a second portion 340 extending from the first vertical portion 339 to the first flange 341.

The second portion 340 of the front wall 337 has an inclined inside face 343, oriented towards the internal space 321, and an outside face 344 having an inclined section 345 extending from the first vertical portion 339 and a vertical section 346 extending from the inclined section 345 to the first flange 341.

The inclined bottom wall 338 extends from the neighborhood of an upper edge 347 of the rear wall 336 to a free end 350 of that wall 338 disposed opposite a lower edge 348 of the front wall 337.

The free end 350 of the inclined bottom wall 338 is disposed above the second flange 342.

The evacuation channel 322 is formed in line with the front wall 337, extends between the first and second flanges 341 and 342, its entry aperture 323 being situated at the location of the free end 350 of the inclined bottom wall 338 and opening into the internal space 321, and its exit aperture 324 being situated away from its entry aperture 323 and provided to be opposite accommodations 319 of the movable support 304.

The supply hopper 320 further comprises several cut-outs 353 provided in the inclined bottom wall 338, open at the location of the free end 350 of the inclined bottom wall 338.

The supply hopper 320 further comprises several ribs 354 provided on the inclined bottom wall 338 and projecting from the internal space 321.

These ribs 354 extend over the whole of the inclined bottom wall 338, from the rear wall 336 to its free end 350, and pass beside the cut-outs 353 on either side thereof.

The inclined bottom wall 338, the lateral walls 335, the rear wall 336 and the front wall 337 are furthermore configured to provide a lower cavity 349 under the inclined bottom wall 338, situated on the other side to the inside space 321.

The supply hopper 320 is furthermore provided with a movable obturating system 355 of the evacuation channel 322, disposed under the inclined bottom wall 338 in the lower cavity 349.

This movable obturating system 355 has an obturating position in which it is configured to obturate at least partly the exit aperture 324 of the evacuation channel 322 when the supply hopper 320 is not positioned on the pillars 352 forming the hopper support; so as to prevent the evacuation of the straws 2.

The supply and positioning device 305 further comprises a mechanism configured to pass the movable obturating system 355 from its obturating position to an evacuation position in which it is configured to be at a distance from the exit aperture 324 of the evacuation channel 322, when the supply hopper 320 is positioned on the pillars 352 forming the hopper support; so as to enable the evacuation of the straws 2.

More specifically, the movable obturating system 355 comprises a bar 362 fastened onto each lateral wall 335 and two arms 357 hinged at an elbow 358 around the bar 362; each arm 357 being provided with a hook 359 at a first end situated at the location of the exit aperture 324 of the channel 322 to hinder the evacuation of the straws 2.

The movable obturating system 355 further comprises a spacing member 360 (visible in FIGS. 18 and 19) connecting the arms 357 by a second respective end, which is an opposite end to the first respective end.

The movable obturating system 355 further comprises two return springs 363 disposed around the bar 362 and rotationally biasing the arms 357 to place the movable obturating system 355 in its obturating position.

The supply and positioning device 305 further comprises a pusher 364 mounted on a T-shaped base 365 of the frame 306 of the installation 301 and which is configured to come to bear on and bias the spacing member 360 and thus the arms 357 against the return springs 363; to pass the movable obturating system from its obturating position to its evacuation position.

It will be noted that the pusher 364, the spacing member 360 and the bar 362 here form the mechanism configured to pass the movable obturating system 355 from its obturating position to its evacuation position.

Figure 17:
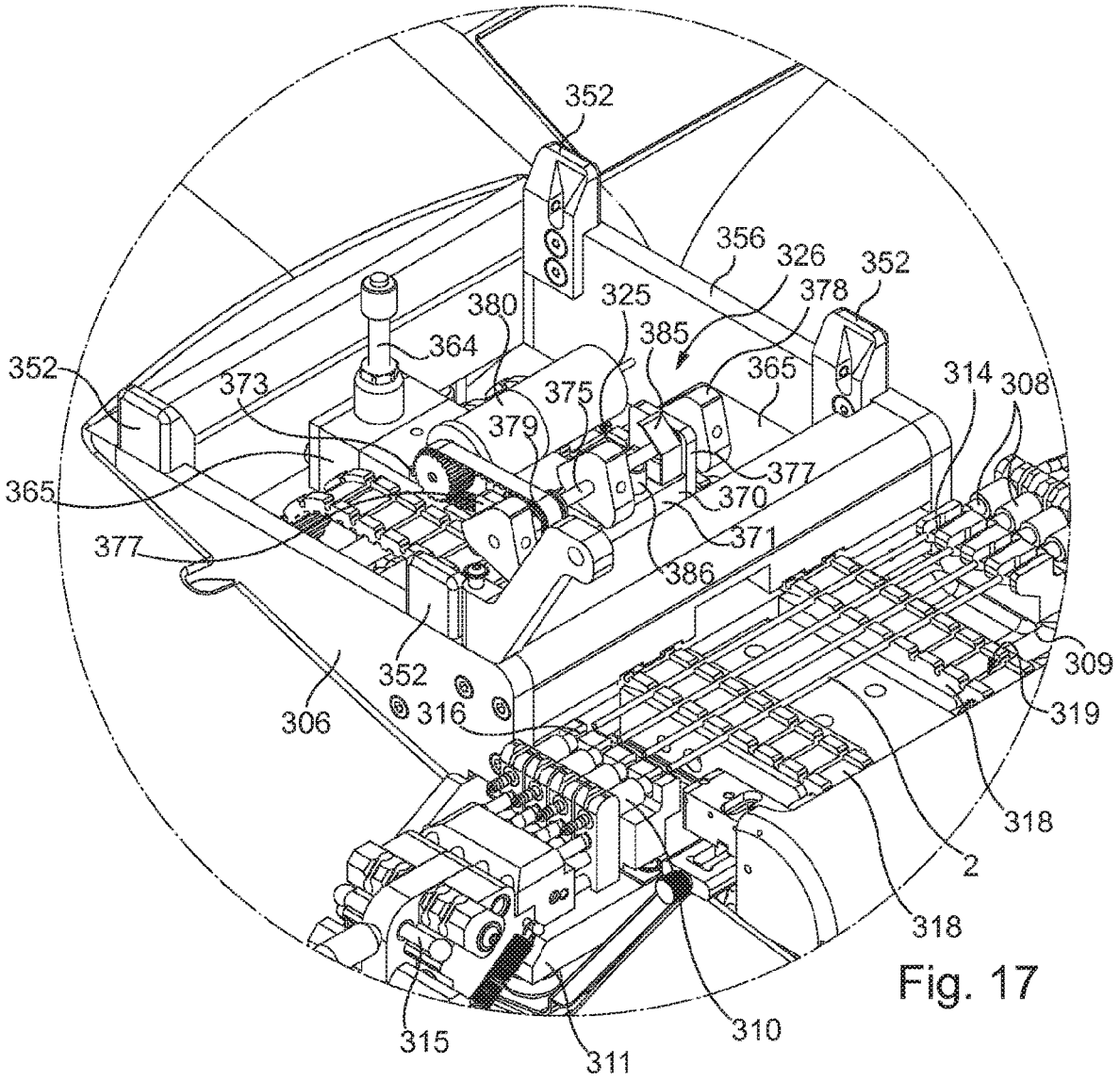
FIG. 17 illustrates an enlargement in perspective of part of the installation of FIG. 14, which part lacks the supply hopper.

The separating system 325 is provided with a movable part 326 configured to enter into contact with the straws 2 and impart movement to them (see FIG. 17).

The separating system 325 comprises a separator mounting 370 and a mechanical connection interface configured to mechanically fasten the movable part 326 to the separator mounting 370.

The movable part 326 and the separator mounting 370 are made from electrically conducting material.

The separator mounting 370 comprises a first block 371 fastened using screws 372 onto the T-shaped base 365 of the frame 306 of the installation 301; as well as a second block 373, distinct from the first block 371, and fastened using screws 374 also on the T-shaped base 365.

The movable part 326 is mounted on the first block 371 and comprises a rotational drive shaft 375 and several separating fingers 376 mounted on the drive shaft 375 and rotationally driven by the latter.

The separating system 325 further comprises two bearing 377 each disposed between two separating fingers 376, fastened on either side of the first block 371 and configured to bear the rotational drive shaft 375.

These bearings 377 form the mechanical connection which mechanically fastens the movable part 326 to the separator mounting 370.

The separating fingers 376 each have a triangular shape with three rounded vertices 378 configured to project into the internal space 321 of the supply hopper 320, through a respective notch 353 formed in the inclined bottom wall 338 of the hopper 320.

The movable part 326 further comprises a first drive cog 379 attachedly mounted on the rotational drive shaft 375.

The separating system 325 further comprises an electric motor 380 mounted on the second block 373 of the separator mounting 370 and provided with a second drive cog 382 configured to rotationally drive the rotational drive shaft 375 of the movable part 326 via a transmission belt 381.

The supply and positioning device 305 further comprises a first electrical connection member 385 directly connected both to the inclined bottom wall 338 of the supply hopper 320 and to the separator mounting 370; as well as a second electrical connection member 386 directly connected both to the movable part 326 and to the separator mounting 370.

The second electrical connection member 386 is distinct from the bearings 377 of the separator system 325 and is configured to be in continuous sliding contact with the drive shaft 375 of the movable part 326 of the separator system 325.

More specifically, the second electrical connection member 386 comprises a metal barrel 387 inserted into a hollow 388 provided in the first block 371 of the separator mounting 370; a metal elastic return member 389, such as a spring, is inserted into the shank 387, as well as an electrically conducting consumable member 390, such as a carbon brush, interposed between the drive shaft 375 and the elastic return member 389 and in continuous contact with these latter.

The first electrical connection member 385 is formed by a metal strip having a first end portion fixedly attached to the first block 371 of the separator mounting 370 via fastening screws; a second end portion elastically biased against the inclined bottom wall 338 of the supply hopper 320 and configured to come into contact with a lower surface of that inclined bottom wall 338; and a junction portion connecting the first and second end portions.

The metal strip here extends at least partly around the drive shaft 375 of the movable part 326 of the separator system 325, the first and second end portions of that strip extending at least partly opposite each other and the drive shaft 375 being interposed between the first and second end portions.

The supply and positioning device 305 thus makes it possible to electrically connect together each of the inclined bottom wall 338 of the supply hopper 320, the movable part 326 of the separator system 325 and the separator mounting 370, via the metal strip, the separating fingers 376, the shaft 375, the carbon brush 390, the spring 389 and the barrel 387; which makes it possible to establish an equipotential connection between these electrically connected members.

It will be noted that the first block 371 of the separator mounting 370 is also connected to the T-shaped base 365 of the frame 306 of the installation 301, which frame 306 may be electrically connected to a more general equipotential connection, for example what is referred to as a ground or earth connection.

To supply the filling and welding machine 303 with straws 2 (not shown), the receptacle 1 is brought, for example from a storage zone or from the printing machine, into its configuration. It is inserted into the hopper 320 with the first longitudinal wall 8 of the first part 3 located adjacent the opening 5, which rests on the inclined bottom wall 338 of the hopper 320 such that the receptacle 1 is oriented with its opening 5 downward and towards the entry aperture 323 and the evacuation channel 322, while its second front wall 28 bears against the spacer 383.

The second lateral walls (not visible) are each bordered by a respective lateral wall 335 of the hopper 320.

The receptacle 1 is thus received in the hopper 320 while being held in a predetermined emptying position.

It will be noted that in this predetermined emptying position, the spacer 383 is configured to hold the receptacle 1 away from the front wall 336 of the supply hopper 320 such that, when the separator system 325 is in operation, the rounded vertices 378 of the separating fingers 376 which are rotating come into contact with the receptacle 1, here at the location of the junction between the first front wall 6 and the first longitudinal wall 8 which rests on the inclined bottom wall 338. This makes it possible to stir the receptacle 1 slightly, so as to promote the pouring of the straws 2 into the hopper 320 through the opening 5, without however destabilizing the receptacle 1 which remains in its predetermined emptying position.

It will also be noted that the hopper 320 is configured such that, in its predetermined emptying position, in the obturating configuration of the receptacle 1, a portion of this latter extends out of the internal space 321 of the hopper 320, beyond the lateral walls 335, in order for it to be grasped.

For the emptying, the user grasps the housing-forming second part 4 of the receptacle 1 to pass the latter from its obturating configuration into its opening configuration in which the first part 3 is only partly inserted into the second part 4.

The back free edge 35 of the second back wall 29 of the second part 4 rests on the projecting fins (not shown) so as not to obturate the opening 5.

As a variant, the user may fully withdraw the second part 4, as in the opening configuration illustrated in FIG. 10.

The straws 2 then pour naturally, under the effect of gravity, into the internal space 321 of the supply hopper 320, at the location of the separating fingers 376, in front of the entry aperture 323 and the evacuation channel 322.

The inclination of the back wall 338 of the hopper 320 is approximately 30° to the horizontal, while the inclination of the inclined wall 23 of the guide ramp 22 has an inclination of approximately 20° relative to the first longitudinal wall 8 which rests on the inclined bottom wall 338. Thus, the inclined wall 23 of the guide ramp 22 here has an inclination of approximately 10° to the horizontal, which enables the progressive pouring of the straws 2 from the internal space 24 of the first part 3 of the receptacle 1.

When the straws 2 pass through the opening 5, they are in their predetermined orientation and are located in the internal space 321 of the supply hopper 320. The straws 2 slide on the ribs 354 of the inclined bottom wall 338, are stirred by the rounded vertices 378 of the separating fingers 376 at the location of the cut-outs 353, enter, one after the other, the vertical channel 322 by its entry aperture 323, then fall, one after the other, through the exit aperture 324, into a respective accommodation 319 on the conveyor belts 318 of the movable support 304, where the straws are accommodated in their predetermined orientation.

Because the straws 2 are formed by a thin tube of plastic material, and that once outside the receptacle 1 they are in sliding contact with the inclined bottom wall 338, and are also in contact with the movable part 326 of the separator system 325 which stirs them, static electricity is liable to be generated in particular at the location of the inclined bottom wall 338 and the movable part 326 of the separator system 325.

The contact between the movable part 326 of the separator system 325 and the receptacle 1, this also being of plastic material, is also liable to generate static elasticity at the location of the inclined bottom wall 338 and the movable part 326 of the separator system 325.

On account of the properties of electrical conduction of the inclined bottom wall 338 and of the movable part 326 of the separator system, and on account of the equipotential link established by the supply and positioning device 305, the latter makes it possible to discharge the static electricity generated in particular at the location of the inclined bottom wall 338, the movable part 326 of the separator system 325 and also at the location of the first front wall 6 of the first longitudinal wall 8 of the receptacle 1.

Therefore, by virtue of this device 305, the straws 2 are not subject to the risk of becoming electrostatically charged to the extent of not entering the evacuation channel 322, for example by remaining in the immediate proximity of the receptacle 1 under the effect of the static electricity, or even of remaining in the receptacle 1. Thus, the supply and evacuation of the straws 2 onto the movable support 304 are facilitated.

The receptacle 1 makes it possible to receive and keep the straws 2 in their predetermined orientation, during its filling, its storage, its transport as well as its emptying. This greatly facilitates the implementation of the associated operations of storage and transport of the straws 2 but also the operation of pouring, filling and welding of these latter.

More particularly, a straw 2 which is not in its predetermined orientation during these operations requires to be manipulated manually or by another machine in order for it to be processed (stored, transported, poured, filled and welded).

The receptacle 1 may be a single-use or re-usable receptacle. Therefore, once the receptacle 1 has been emptied, it can be re-used to receive straws 2 once again, or else it can be disposed of, whether or not with a view to being recycled.

The receptacle 1 is obtained here by forming into shape, through folding, each of the first and second parts 3 and 4.

This is particularly convenient since, before forming into shape, it can be kept in the state of a blank in order to be as compact as possible.

It may also be particularly convenient to put it back into the state of the blank once emptied, with a view to a later use or with a view to disposing of it and possibly recycling it, for the same constraint of compactness.

Figure 20:
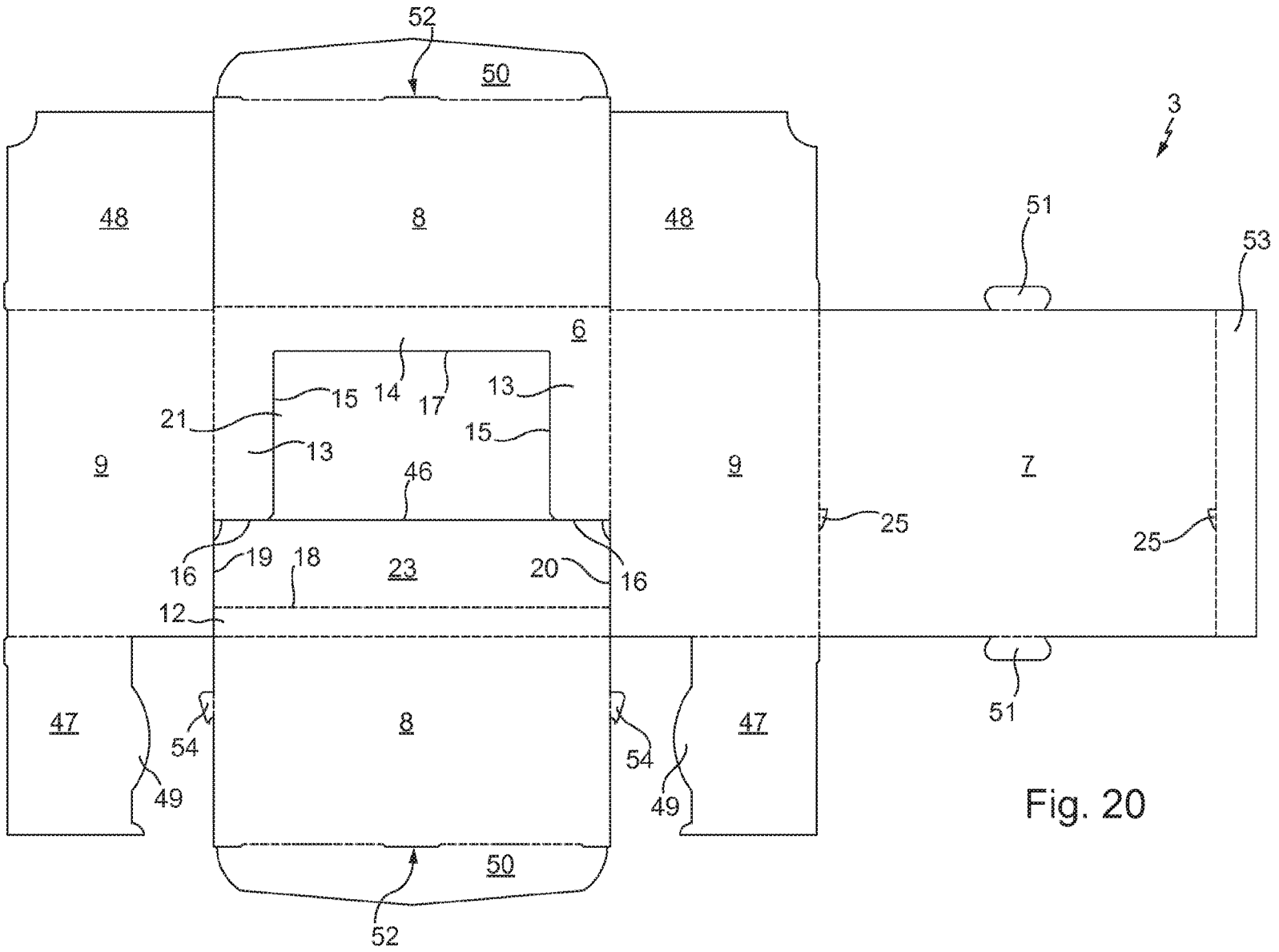
FIGS. 20 and 21 are respectively views of the accommodation-forming first part and of the cover-forming second part of the storage receptacle visible in particular in FIGS. 1 to 10, here in the state of a blank.
Figure 21:
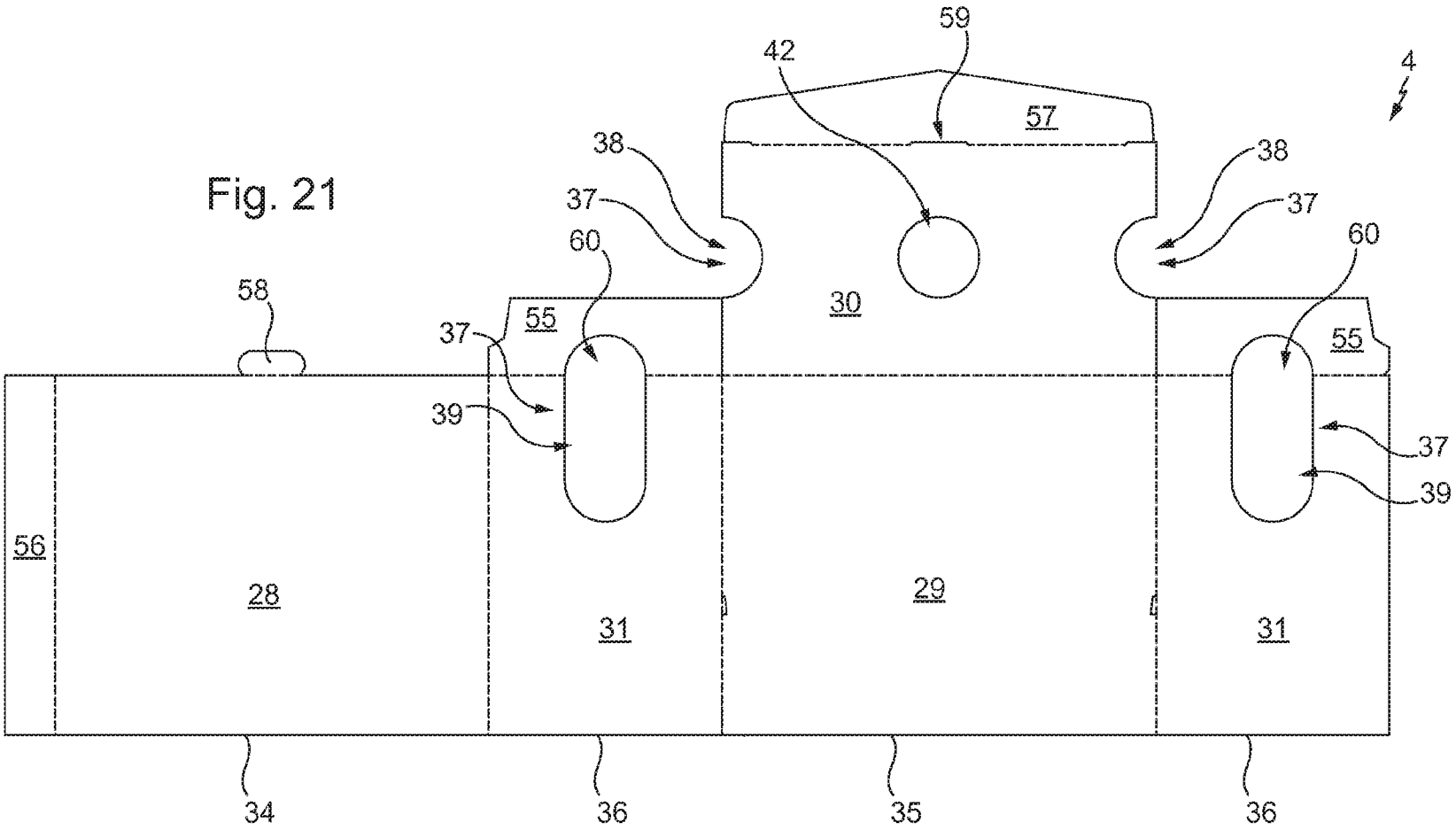

The state of a blank of the first part 3 is illustrated in FIG. 20 while the state of a blank of the second part 4 is illustrated in FIG. 21.

In these FIGS. 20 and 21, the dashed lines represent fold lines, while the full lines represent what are referred to as free edges.

As regards the first part 3, illustrated in FIG. 20, the first front wall 6, the two first longitudinal walls 8, the two first lateral walls 9 and the first back wall 7 each have a rectangular shape and each has two first longitudinal edges, opposite each other, and two first lateral edges, opposite each other and each meeting one and the other of the first longitudinal edges.

Here, that is to say in the orientation of the first part 3 in the state of a blank as illustrated in FIG. 20, all the longitudinal edges have the same orientation referred to as left-right while the lateral edges have the same orientation referred to as up-and-down.

The first front wall 6 has a longitudinal edge in common with one of the first longitudinal walls 8, at the location of the portion in the form of a longitudinal strip 12, while its other longitudinal edge is in common with the other of the first longitudinal walls 8, on the other side to the portion in the form of a longitudinal strip 12.

The first front wall 6 has a lateral edge in common with one of the first lateral walls 9, while its other lateral edge is in common with the other of the first lateral walls 9.

One of the first lateral walls 9 has a lateral edge in common with the first front wall 6, while its other lateral edge is common to the first back wall 7.

The cut-out 21 is delimited here by the lateral inside edges 15, by the third longitudinal inside edge 17, and also by an end longitudinal edge 46 of the inclined portion 23 forming the guide ramp 22, which end longitudinal edge 46 is opposite the longitudinal inside edge 18 from which extends the inclined portion 23.

From each lateral wall 9 extends a first extension portion 47 and a second extension portion 48, each substantially rectangular and having two first longitudinal edges, opposite each other, and two first lateral edges, opposite each other and each meeting one and the other of the first longitudinal edges.

The first extension portion 47 extends the first lateral wall 9 from one of its longitudinal edges which is adjacent the portion in the form of a longitudinal strip 12, while the second extension portion 48 extends the second lateral wall 9 from the other of its longitudinal edges.

When the first part 3 of the receptacle 1 is formed into shape, the extension portion 47 is configured to come against the first longitudinal wall 8 from where extends the portion of strip form 12, while the second extension portion 48 is configured to come against the other of the first longitudinal walls 8, the portions 47 and 48 each being on the same side as the internal space 24 of the first part 3.

Each extension portion 47 has, along one of it transverse edges, a projecting portion 49 having a curved contour.

When the first part 3 of the receptacle 1 is formed into shape, this projecting portion 49 is configured in order for the end edge 46 of the inclined portion 23 to be wedged between this projecting portion 49 and the first longitudinal wall 8 from which extends the portion in the form of a longitudinal strip 12.

These projecting portions 49 are configured to avoid a straw 2 remaining held against the end longitudinal edge 46 of the inclined portion 23 when the receptacle 1 is in course of emptying.

From each first longitudinal wall 8 there extends a longitudinal extension portion 50, extending this first longitudinal wall 8 from its opposite longitudinal edge to the first front wall 6.

When the first part 3 of the receptacle 1 is put into form, each longitudinal extension portion 50 is configured to come against the first back wall 7, while being on the same side as the internal space 24.

The first part 3 furthermore has two fastening lugs 51 each provided projecting from a respective longitudinal edge of the first back wall 7, and two cut-outs 52 each provided at the junction between a first longitudinal wall 8 and its longitudinal extension portion 50.

Each notch 52 is configured to receive a fastening lug 51 when the first part 3 of the receptacle 1 is put into form.

The first part 3 furthermore has a bonding flap 53, extending the first back wall 7 from its opposite transverse edge to the first lateral wall 9 with which the back wall 7 has an edge in common.

The bonding flap 53 is configured to be applied against and bonded to the lateral wall 9 which is opposite that with which the back wall 7 has a common edge, when the first part 3 of the receptacle 1 is formed into shape.

The first part 3 furthermore has two fastening tabs 54 each provided projecting from a respective transverse edge of the first longitudinal wall 8 against which come the first extension portions 47 when the first part 3 of the receptacle 1 is formed into shape.

Each fastening tab 54 is configured to snap fasten onto a transverse edge of an extension portion 47 so as to fasten thereto the longitudinal wall 8 when the first part 3 of the receptacle 1 is formed into shape.

As regards the second part 4, illustrated in FIG. 21, the second front wall 28, the second longitudinal wall 30, the two second longitudinal walls 31, and the second back wall 29 each have a rectangular shape and each has two first longitudinal edges, opposite each other, and two first lateral edges, opposite each other and each meeting one and the other of the first longitudinal edges.

Here, that is to say in the orientation of the second part 3 in the state of a blank as illustrated in FIG. 21, all the longitudinal edges have the same orientation referred to as left-right while the lateral edges have the same orientation referred to as up-and-down (as in FIG. 20).

The second back wall 29 has a longitudinal edge in common with the second longitudinal wall 30, while its other longitudinal edge forms the back free edge 35.

The second back wall 29 has a lateral edge in common with one of the second lateral walls 31, while its other lateral edge is in common with the other of the second lateral walls 31.

One of the second lateral walls 31 has a lateral edge in common with the second back wall 29, while its other lateral edge is in common with the second front wall 28.

The second part 4 furthermore has, for each lateral wall 31, a substantially rectangular extension portion 55 having two first longitudinal edges, opposite each other, and two first lateral edges, opposite each other and each meeting one and the other of the first longitudinal edges.

The extension portion 55 extends the second lateral wall 31 from one of its longitudinal edges which is situated adjacent the second longitudinal wall 30.

The other longitudinal edge of the second lateral wall 31 form the lateral free edge 36.

When the second part 4 of the receptacle 1 is put into form, the longitudinal extension portion 55 is configured to come against the second longitudinal wall 30, while being on the same side as the internal space 32 of the second part 4.

The second part 4 furthermore has bonding flap 56, extending the second front wall 28 from its opposite transverse edge to the second lateral wall 31 with which the front wall 28 has an edge in common.

The bonding flap 56 is configured to be applied against and bonded to the lateral wall 31 which is opposite that with which the front wall 28 has a common edge, when the second part 4 of the receptacle 1 is formed into shape.

The second part 4 furthermore has a longitudinal extension portion 57, extending the second longitudinal wall 30 from its longitudinal edge that is not linked to the second back wall 29.

When the second part 4 of the receptacle 1 is put into form, the longitudinal extension portion 57 is configured to come against the second front wall 28, while being on the same side as the internal space 32.

The second part 4 furthermore has a fastening lug 58 provided projecting from a longitudinal edge of the second front wall 28, and a notch 59 provided at the junction between the second longitudinal wall 30 and its longitudinal extension portion 57.

The notch 59 is configured to receive the fastening lug 58 when the second part 4 of the receptacle 1 is put into form.

Each cut-out 37 is partly formed by a recess 60 of one of the extension portions 55 configured to come opposite the longitudinal portion 38 of the cut-out 37 which is provided in the second longitudinal wall 30, when the second part 4 of the receptacle 1 is put into form.

In variants that are not illustrated:

- at least one of the lateral edges delimiting the recess-forming strip provided in the first front wall of the first part is not formed on one of the lateral walls of the first part, but between those lateral walls;
- at least one incision forming a projecting fin is not provided in the first back wall but is provided in the first front wall or in one of the two first lateral walls of the first part;
- at least one incision forming a notch configured to receive a projecting fin is not provided in the second back wall but is provided in the second front wall or in one of the two second lateral walls of the second part;
- at least one first cut-out has a longitudinal portion which is provided in the second longitudinal wall of the second part, and a lateral portion which is provided in the second front wall or in the second back wall of the second part, rather than in one of the second lateral walls;

the first front wall of the first part has no cut-out open to the recess-forming longitudinal strip;

the second part only has a single first cut-out rather than two, or more than two first cut-outs;

the supply hopper has no removable spacer and its front wall is configured to hold the receptacle in the predetermined emptying position in which the separating fingers which are rotating come into contact with the receptacle;

in the predetermined emptying position, the receptacle is at a distance from the separating fingers which are rotating, such that these latter do not come into contact with the receptacle and/or the receptacle is not formed from plastic material but rather from cardboard, for example recyclable.

Numerous other variants are possible according to circumstances, and in this connection it is to be noted that the invention is not limited to the examples described and shown.

The invention claimed is:

1. A receptacle configured to store at least temporarily a plurality of straws, each of predetermined length and provided for the packaging of a predetermined dose of animal semen, said receptacle being configured to equip an installation for processing said straws provided with one or more machines for processing said straws, comprising:

a passage opening for said straws, extending at least in a longitudinal direction corresponding to a predetermined orientation of said straws for their passage;

a first accommodation-forming part for accommodation of said straws and a cover-forming second part, said first part being configured to be slidingly inserted into said second part such that said receptacle has an opening configuration in which said first part is partially inserted into said second part and said opening is free for the passage of said straws through that opening in said predetermined orientation, and an obturating configuration in which said first part is inserted into said second part and said opening is obturated by said second part to prohibit the passage of said straws through said opening;

said first part having a parallelepiped shape and having a first front wall in which is at least partially provided said passage opening, a first back wall opposite said first front wall, two first longitudinal walls opposite each other, each meeting said first front wall and said first back wall and extending parallel to said passage opening, and two first lateral walls opposite each other and each meeting said first front wall, said first back wall and the two said longitudinal walls;

each first lateral wall having two diagonals each having a length less than or equal to said predetermined length of said straws;

wherein said first part comprises an internal space as well as a guide ramp formed by a first portion of said first front wall, which extends from the junction of the latter with one of the two said first longitudinal walls, and by a second inclined portion extending said first portion forming said guide ramp and extending in said internal space of said first part;

wherein said second inclined portion forming said guide ramp extends until it meets said first longitudinal wall from which extends said first portion forming said guide ramp.

2. A receptacle according to claim 1, wherein said first portion and said second inclined portion forming said guide ramp meet at a junction defining a first longitudinal inside edge of said first front wall and which partially delimits said passage opening.

3. A receptacle according to claim 1, wherein said second inclined portion forming said guide ramp has an angle of inclination less than or equal to approximately 20° relative to said first longitudinal wall from which extends said first portion forming said guide ramp.

4. A receptacle according to claim 1, wherein said first part has a longitudinal recess-forming strip, which is provided in said first front wall and delimited at least by a first longitudinal inside edge of said first front wall and by two lateral edges on said first part and opposite each other, said longitudinal recess-forming strip at least partially defining said passage opening.

5. A receptacle according to claim 4, wherein said two lateral edges are formed on the two said first lateral walls such that said longitudinal strip extends from one to the other of these latter.

6. A receptacle according to claim 4, wherein said first part has a cut-out provided in said first front wall and which is open to said recess-forming longitudinal strip on the opposite side to said first longitudinal inside edge.

7. A receptacle according to claim 1, wherein said cover-forming second part is of parallelepiped shape and has a second front wall, a second back wall opposite said second front wall, a second longitudinal wall meeting said second front wall and said second back wall, two second lateral walls opposite each other and each meeting said second front wall, said second back wall and said second longitudinal wall, and an opening for insertion of said first part into an internal space of said second part.

8. A receptacle according to claim 7, wherein said internal space of said second part is delimited by said second front wall, said second back wall, said second longitudinal wall and said two second lateral walls; while said insertion opening is delimited by a front free edge of said second front wall, a back free edge of said second back wall, and two lateral free edges of said two second lateral walls.

9. A receptacle according to claim 7, wherein said second part has at least one first cut-out provided both in said second longitudinal wall and in one of said second lateral walls, second front wall and second back wall.

10. A receptacle according to claim 9, wherein said at least one first cut-out has a portion provided in one of said second lateral walls, second front wall and second back wall, which is configured to be at least partially opposite said first part, both in said obturating configuration and in said opening configuration in which said first part is partially inserted into said second part.

11. A receptacle according to claim 7, wherein said second part has a second cut-out entirely formed in said second longitudinal wall.

12. A device according to claim 1, wherein said passage opening is entirely formed in said first part, or said opening is delimited by a longitudinal edge of said first part and by a longitudinal edge of said second part, situated opposite said longitudinal edge of said first part.

13. A receptacle according to claim 1, further comprising a device for locking in position said first part relative to said second part, configured to prevent said receptacle from freely passing from one to the other of its opening and obturating configurations.

14. A receptacle according to claim 13, wherein said locking device comprises, on said first part, one of at least one projecting fin and at least one notch, and on said second part, the other of said at least one projecting fin and of said at least one notch, said at least one projecting fin being configured to be inserted into said at least one notch in the obturating configuration of said receptacle or in the opening configuration of said receptacle in which said first part is partially inserted into said second part.

15. A receptacle according to claim 14, wherein said at least one projecting fin is formed by a first incision made in one of said first front wall, first back wall and first lateral walls of said first part, said at least one notch is formed by a second incision made in one of said second front wall, second back wall and second lateral walls of said second part; with, in the obturating configuration of said receptacle, said at least one projecting fin being received in said at least one notch and, in the opening configuration in which said first part is partially inserted into said second part, a free edge of one of said second front wall, second back wall and second lateral walls of said second part which rests on said at least one projecting fin.

16. A processing installation for straws comprising at least one processing machine for straws, comprising a receptacle according to claim 1.

17. An installation according to claim 16, wherein said receptacle comprises an identification medium configured to encode information identifying said straws stored in said receptacle, and said at least one processing machine comprises a control-command unit configured to retrieve said encoded information from said identification medium and for controlling and commanding said at least one processing machine according to said retrieved information.

18. An installation according to claim 16, wherein said at least one processing machine is a printing machine for straws configured to eject, at an exit from said machine, said straws in said predetermined orientation, and said receptacle is disposed at an exit from said machine to receive said straws through said passage opening.

19. An installation according to claim 16, wherein said at least one processing machine is a machine for filling and/or welding straws, comprising a supply hopper configured to receive said receptacle for the emptying of the latter.

* * * * *